US010149505B2

(12) United States Patent
Pandolfino

(10) Patent No.: US 10,149,505 B2
(45) Date of Patent: Dec. 11, 2018

(54) NECKWEAR AND FASTENERS

(71) Applicant: PATUGA LLC, Clarence, NY (US)

(72) Inventor: Joseph Pandolfino, Clarence, NY (US)

(73) Assignee: PATUGA LLC, Clarence, NY (US)

( * ) Notice: Subject to any disclaimer, the term of this patent is extended or adjusted under 35 U.S.C. 154(b) by 1 day.

(21) Appl. No.: 15/386,073

(22) Filed: Dec. 21, 2016

(65) Prior Publication Data

US 2018/0168294 A1 Jun. 21, 2018

Related U.S. Application Data

(63) Continuation of application No. 15/384,540, filed on Dec. 20, 2016.

(51) Int. Cl.

| | |
|---|---|
| ***A44C 5/20*** | (2006.01) |
| ***A41D 15/00*** | (2006.01) |
| ***A41D 25/00*** | (2006.01) |
| ***A41D 27/00*** | (2006.01) |
| ***A44B 11/26*** | (2006.01) |
| ***A44B 17/00*** | (2006.01) |
| ***A44C 15/00*** | (2006.01) |
| ***A44C 5/14*** | (2006.01) |
| ***A41D 27/08*** | (2006.01) |
| ***A44B 6/00*** | (2006.01) |

(52) U.S. Cl.

CPC ..... *A41D 25/005* (2013.01); *A41D 15/002* (2013.01); *A41D 25/003* (2013.01); *A41D 27/08* (2013.01); *A44B 6/00* (2013.01); *A44B 11/266* (2013.01); *A44B 17/0041* (2013.01); *A44B 17/0064* (2013.01); *A44C 5/147* (2013.01); *A44C 5/2076* (2013.01); *A44C 15/005* (2013.01)

(58) Field of Classification Search

CPC ..... A44C 5/2076; A44B 11/266

See application file for complete search history.

(56) References Cited

U.S. PATENT DOCUMENTS

| | | | |
|---|---|---|---|
| D112,303 | S | 11/1938 | Huddle |
| 3,167,784 | A | 2/1965 | Less |
| D230,540 | S | 3/1974 | Gillman |
| 4,546,494 | A | 10/1985 | Garber |
| 4,627,113 | A | 12/1986 | Lord |
| 5,003,636 | A | 4/1991 | Marostica |

(Continued)

FOREIGN PATENT DOCUMENTS

| | | | |
|---|---|---|---|
| AT | 389630 | B | 1/1990 |
| CN | 2888922 | Y | 4/2007 |
| WO | 88/06414 | A1 | 9/1988 |

OTHER PUBLICATIONS

Engineering Corner, https://www.shapeways.com/product/MUT37CQWA/articulated-necktie-clips-on-to-your-top-button.

(Continued)

*Primary Examiner* — Robert Sandy

(74) *Attorney, Agent, or Firm* — Sughrue Mion, PLLC

(57) ABSTRACT

A neckwear includes a neckband, a neckband module and one or more torso segments connected by fasteners. The neckwear may include a plurality of pivoting, intra-changeable, metallic torso segments. Also provided are improved take-apart fasteners and improved quick-release buckles, for use in neckwear, jewelry, wristwatches and watchbands or for otherwise securing objects.

7 Claims, 20 Drawing Sheets

(56) References Cited

U.S. PATENT DOCUMENTS

| | | | | |
|---|---|---|---|---|
| 5,016,285 | A | 5/1991 | Just | |
| D318,754 | S | 8/1991 | Hughes | |
| 5,036,550 | A | 8/1991 | Wilsey | |
| D320,499 | S | 10/1991 | White et al. | |
| 5,148,582 | A * | 9/1992 | Dennis, Jr. | A44B 11/006 24/573.11 |
| D374,111 | S | 10/1996 | Wilson | |
| 5,673,434 | A | 10/1997 | Risk | |
| 5,778,498 | A * | 7/1998 | Laks | A43C 11/00 24/615 |
| D398,435 | S | 9/1998 | Gray | |
| 6,226,844 | B1 | 5/2001 | Lerra et al. | |
| 6,728,999 | B2 * | 5/2004 | Murai | A44B 11/266 24/614 |
| 6,792,654 | B2 | 9/2004 | Schmitz | |
| D663,916 | S | 7/2012 | Bracey | |
| 9,161,582 | B2 | 10/2015 | Anderson | |
| D748,370 | S | 2/2016 | Johnson | |
| D775,777 | S | 1/2017 | Peral | |
| 2014/0260425 | A1 * | 9/2014 | Slabaugh | A44C 5/2052 63/3.1 |
| 2015/0201712 | A1 | 7/2015 | Keller | |

OTHER PUBLICATIONS

The fusionguy, https://thefusionguy.wordpress.com/category/woodworking/.
http://woodknot.com/.
http://www.jebiga.com/cams-wooden-ties-new-take-fashion/.
https://www.vat19.com/item/wood-tie.
International Search Report dated Apr. 13, 2017 from the International Searching Authority in application No. PCT/US2016/068168.
Written Opinion dated Apr. 13, 2017 from the International Searching Authority in application No. PCT/US2016/068168.

* cited by examiner

NECKWEAR AND FASTENERS

This application is a continuation of U.S. patent application Ser. No. 15/384,540, filed Dec. 20, 2016, the entire contents of which are herein incorporated by reference.

FIELD

The present disclosure relates to neckwear and fasteners.

INTRODUCTION

The modern necktie, otherwise known simply as the tie, is a long piece of fabric worn around the neck that hangs down the front of a shirt, typically resting under the shirt collar and knotted at the throat. The evolution of the necktie is rooted in military history. One of the earliest known examples of neckwear was during the reign of Chinese Emperor Qin Shi Huang who was buried with thousands of life-size terracotta replicas of his warriors circa 210 BC in Xi'an, China. The statues were discovered in the twentieth century and included neckwear on the warriors. Some historians believe that this neckwear was used as a badge of honor for the emperor's army. Another early example of neckwear is portrayed in Trajan's column completed circa 133 AD in Rome commemorating Roman Emperor Trajan's victory in the Dacian Wars, in which certain Roman soldiers are depicted wearing various styles of neckwear.

The forerunner of the modern tailored necktie is the cravat believed to originate in the 17th century courtesy of a regiment of Croatian mercenaries arriving in France. The cravat is a wide straight piece of fabric worn around the neck and tied in the open neck of a shirt. King Louis XIV was enamored by "la cravate" and it was soon imitated by his military units and those of rank. The novel fashion accessory spread throughout Europe including to those outside of military establishments.

*Neckclothitania*, published circa 1818, illustrated various methods to tie a cravat and was one of the first publications to use the word "tie" in reference to men's neckwear. *The Art of Tying the Cravat* followed circa 1828. In the United States of America, over subsequent decades the word "tie" was used interchangeably with the word "cravat" and by the early twentieth century, neckties became more popular than bowties; the latter generally reserved for formalwear.

The necktie today is predominantly worn by people in white collar occupations and for holidays, special occasions and religious ceremonies. Neckties are an important feature of formal and semi-formal attire and other functions of a necktie include covering the front shirt buttons and placket (or if a button-down shirt does not have a placket, the vertical line created by the two overlapping front shirt panels) and bridging the gap between the shirt collars along the neckline. As compared to an open collar, wearing a necktie signifies care and respect during social and professional gatherings. Moreover, choice of a necktie facilitates individual expression and can assist in setting the mood for a holiday or special occasion.

In support of the adage "dress for success," studies have concluded that dressing formally is associated with enhanced abstract and concrete cognitive processing and greater positive perceptions of oneself and by others. Characteristics such as competence and authoritativeness are generally projected by formal business attire. See Peluchette, J. V. and Karl, K., The impact of workplace attire on employee self-perceptions, *Human Resource Development Quarterly,* 18(3): 345-360 (2007); Slepian et al., The Cognitive Consequences of Formal Clothing, *Social Psychological and Personality Science,* 6(6): 661-668 (2015); and Damhorst, M L., In Search of a Common Thread: Classification of Information Communicated Through Dress, *Clothing and Textiles Research Journal,* 8(2): 1-12 (1990).

Variants of the necktie include the ascot tie, bow tie and bolo tie. Generally, these do not serve the aforementioned functions of the necktie. Clip-on ties imitate neckties and bow ties and clip-on neckties are generally worn by children and adolescents. Clip-on neckties are also used by those in law enforcement as a safeguard in the event of physical confrontations. Otherwise, when worn by adults, clip-on neckties are sometimes considered juvenile and can be easily or unintentionally detached.

Types of necktie knots include the Four-In-Hand, the Windsor, the Half-Windsor, the Simple also known as the Kent or the Oriental, the Victorian, the Prince Albert, the Pratt also known as the Shelby, the Kelvin, the Balthus, the Murrell, the Van Wijk, the Trinity, and the Eldredge. Certain necktie knots including the Windsor or Balthus are intended to be symmetrical and others such as the Four-In-Hand are not. Tying a perfectly symmetrical necktie including the Windsor or Balthus is difficult to accomplish. Even if the necktie knot is symmetrical, necktie symmetry can rarely be achieved since the fabric below the necktie knot often folds and crinkles in an unsymmetrical manner. Accomplishing an acceptable-looking necktie knot in conjunction with the tied necktie being satisfactory in length is even a more difficult task and often a frustrating experience requiring more than one attempt. Traditionally the length of the necktie is generally preferred to end at approximately the beltline.

The necktie's outward appearance has remained essentially static for many decades other than minor variations resulting from different types of necktie knots and variations in the width of neckties, which vary at any given time period and from time period to time period depending on fashion trends. Nevertheless, there have been some improvements and novel modifications to the necktie such as U.S. Pat. Nos. 1,447,090 and 1,448,453 which provide improved lining for a necktie to be sufficiently elastic or resilient in character that is stitched to the body material to prevent breaking of the stitching or distortion of the tie when subjected to pulling strain. This necktie became known as the "Langsdorf Tie" and these improvements are still utilized today.

Neckwear resembling neckties including bolo ties and variations thereof have been contemplated, but various drawbacks and deficiencies exist as compared to the present disclosure. For example, U.S. Pat. No. 9,210,958 B1 to Hodge discloses a bolo-style necktie having multiple strands similar in appearance to a horse tail depending freely from one another from a clasp or gathering device at the front of the neck or upper chest. Among other drawbacks and deficiencies, the Hodge bolo-style tie, like other bolo ties and bolo tie variations, does not cover all the front shirt buttons or placket, appears asymmetrical on the wearer, and does not have an intra-change ability feature.

Since neckties hang down the middle of a person's entire torso, they are easily and often soiled or permanently stained by food, beverages, ink, ashes or burn holes from smoking, and other contaminants. Consequences of these accidents include embarrassment, professional dry-cleaning expenses and even disposal of the necktie. In addition to these drawbacks, neckties and other types of neckwear resembling neckties have drawbacks and deficiencies selected from the following group: nondurable, easily wrinkles, fabric easily snags, susceptible to burn holes from smoking, limited or no intra-changeability, limited or no interchangeability, appear asymmetrical to an observer when worn, do not remain straight on the wearer due to lack of fastener such as a tie clip, and do not cover all the front shirt buttons.

SUMMARY

One aspect is a neckwear, comprising a neckband, a neckband module, at least one torso segment, and at least one fastener; wherein the neckband is connected to the neckband module, and the neckband module is connected to said at least one torso segment, and wherein said at least one fastener includes a fastener that pivotally connects said neckband module to said at least one torso segment.

The at least one torso segment may be a plurality of torso segments, said plurality of torso segments including a first torso segment and a second torso segment; wherein said at least one fastener further comprises a second fastener that connects said first torso segment with said second torso segment, and wherein said torso segments are capable of pivoting. Each of said at least one torso segment may be configured to be intra-changeable with at least one of the other torso segments of the neckwear. The at least one torso segment may be metallic. One or more of said plurality of torso segments may include a torso-clip segment capable of securing said neckwear to a shirt.

The at least one fastener may include a first hinge member comprising a first leaf, a knuckle, a key groove, a keyway and a pin, and a second hinge member comprising a second leaf, a key and a barrel; wherein the key groove is configured to receive the key and the barrel is configured to receive the pin, and, when the fastener is locked or in use, the key is engaged with the key groove and the pin is engaged with the barrel allowing the first and second hinge members to pivot about the pin; and wherein, the keyway is configured to receive the key during locking and unlocking of the fastener, and the keyway comprises at least one leg. The keyway may comprise at least first and second legs; the first leg of the keyway intersects the key groove at a first entry point accommodating the key, and the second leg of the keyway intersects the first leg of the keyway.

The at least one fastener may include a quick-release buckle, said quick-release buckle including a first buckle member and a second buckle member; wherein either said buckle member engages the other said buckle member, wherein the first buckle member comprises a center guide, a spring and two spring-fit arms, the first buckle member mounted to a first hinge being disposed a first distance above the first hinge and rotating about the first hinge, and wherein the second buckle member comprises a receiving chamber with two release openings, the second buckle member mounted to a second hinge being disposed a second distance above the second hinge and rotating about the second hinge.

Another aspect is a fastener, comprising a first hinge member comprising a first leaf, a knuckle, a key groove, a keyway and a pin, and a second hinge member comprising a second leaf, a key and a barrel; wherein the key groove is configured to receive the key and the barrel is configured to receive the pin, and, when the fastener is locked or in use, the key is engaged with the key groove and the pin is engaged with the barrel allowing the first and second hinge members to pivot about the pin, and wherein, the keyway is configured to receive the key during locking and unlocking of the fastener, and keyway comprises at least one leg. The keyway may comprise at least first and second legs; the first leg of the keyway intersects the key groove at a first entry point accommodating the key, and the second leg of the keyway intersects the first leg of the keyway.

The first leg of the keyway may extend along a longitudinal axis of the pin and the second leg of the keyway may extend circumferentially with respect to the pin. The key groove may extend circumferentially with respect to the pin. The keyway may comprise at least three legs comprising the first leg, the second leg, and a third leg, and the third leg intersects the second leg. The keyway may comprise at least four legs comprising the first leg, the second leg, the third leg, and a fourth leg, and the fourth leg intersects the third leg. The first leg of the keyway may extend along a longitudinal axis of the pin, the second leg of the keyway may extend circumferentially with respect to the pin, and the third leg of the keyway may extend along the longitudinal axis of the pin. The keyway may comprise at least five legs comprising the first leg, the second leg, the third leg, the fourth leg, and a fifth leg, and the fifth leg intersects the fourth leg.

In another aspect, a neckwear comprises one or more of the fastener described above.

In another aspect, a quick-release buckle, comprises a first buckle member, and a second buckle member, wherein either of said first buckle member or said second buckle member engages the other said first buckle member or said second buckle member; wherein the first buckle member comprises a center guide, a spring and two spring-fit arms, the first buckle member mounted to a first hinge or a first mounting shaft, and the second buckle member comprises a receiving chamber with two release openings, the second buckle member is mounted to a second hinge or a second mounting shaft. The first buckle member may be mounted to the first hinge, disposed a first distance above the first hinge, and rotates about the first hinge, and the second buckle member may be mounted to the second hinge, disposed a second distance above the second hinge, and rotates about the second hinge. The first buckle member may instead be mounted to first mounting shaft, and the second buckle member may instead be mounted to the second mounting shaft.

In another aspect, an article comprises one or more of the quick-release buckle members described above. The article may be a necklace, bracelet, purse handle, purse chain, neckband module for neckwear, or torso segment for neckwear. The article may be a neckwear.

In another aspect, a quick-release buckle comprises a first buckle member and a second buckle member, wherein either of said first buckle member or said second buckle member engages the other of said first buckle member and said second buckle member; wherein the first buckle member comprises a center guide, a spring, two spring-fit arms and a pin or pin receptacle, and the second buckle member comprises a receiving chamber with two release openings and a pin or pin receptacle.

In another aspect, an article comprises one or more of the quick-release buckle members discussed above. The article may be a wristwatch, watchband, or neckwear. The article may also be a necklace, bracelet, purse handle, purse chain, neckband module for neckwear, or torso segment for neckwear.

Another aspect is a quick-release buckle comprising a first buckle member, and a second buckle member, wherein either of said first buckle member or said second buckle member engages the other of said first buckle member and said second buckle member, wherein the first buckle member comprises a center guide, a spring, two spring-fit arms and a mounting housing configured to receive a mounting member, and the second buckle member comprises a receiving chamber with two release openings.

In another aspect, an article comprises one or more of the quick-release buckle members discussed above. The article may be a necklace, bracelet, purse handle, purse chain, wristwatch, watchband, neckband module for neckwear, or torso segment for neckwear. The first buckle member may comprise a center guide, a spring, two spring-fit arms, and the second buckle member comprises a receiving chamber with two release openings and a mounting housing configured to receive a mounting member.

In another aspect, an article comprises one or more of the quick-release buckle member discussed above. The article may be a wristwatch, watchband, or neckband. The article may be a necklace, bracelet, purse handle, purse chain, neckband module for neckwear, or torso segment for neckwear.

In another aspect, an interchangeable watchband comprises at least one buckle member; wherein at least one buckle member comprises a center guide, a spring, two spring-fit arms, and a mounting housing.

In another aspect, an interchangeable watchband comprises at least one buckle member; wherein at least one buckle member comprises a receiving chamber with two release openings and a mounting housing.

In another aspect, an interchangeable wristwatch comprises at least one buckle member selected from the group consisting of a first buckle member and a second buckle member; wherein the first buckle member includes a center guide, a spring and two spring-fit arms, and wherein the second buckle member includes a receiving chamber with two release openings.

Another aspect is a torso segment for a neckwear, said torso segment being configured to be interchangeable with at least one other torso segment of said neckwear.

In another aspect, a torso segment comprises at least a portion of a fastener.

DETAILED DESCRIPTION OF THE EXEMPLARY EMBODIMENTS

Figure 1A:
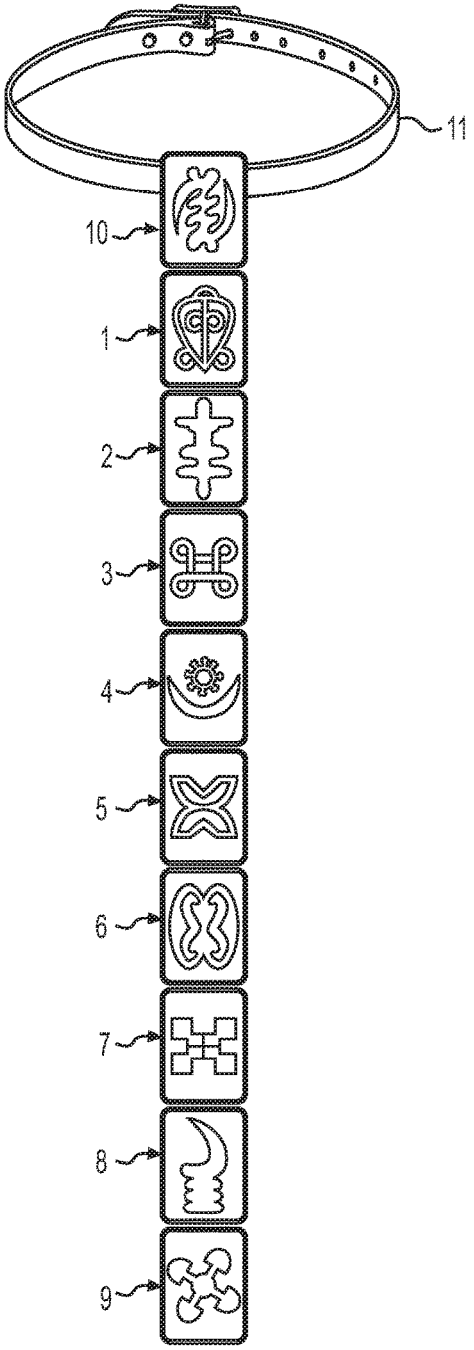
FIG. 1A is a frontal view of an exemplary embodiment of a neckwear including a neckband 11, a neckband module 10, and nine intra-changeable, rounded-rectangle torso segments 1-9.

The present inventor identified a need for neckwear that rectifies the aforementioned drawbacks and deficiencies of neckties and neckwear resembling neckties and maintains the functions of the necktie including being an important component of formal or semi-formal attire, covering the front shirt placket and all the front shirt buttons in certain embodiments, and bridging the gap between the shirt collars along the neckline. In one aspect, the exemplary embodiments described below provide comfortable neckwear as a functional and fashionable necktie alternative comprising a neckband and a neckband module connected to one or more torso segments by one or more fasteners. The neckband module is situated at approximately the same position on the wearer as a necktie knot and is supported by the neckband.

In another aspect, exemplary embodiments provide two types of fasteners, an improved take-apart fastener and an improved quick-release buckle. Each of the instant fasteners, as further described below, may be utilized with a neckwear and for other applications, including jewelry and non-jewelry items. The strength of the instant fasteners make them an ideal solution for many applications.

In some exemplary embodiments, a neckwear comprises a series of torso segments that pivot (move from front to back and back to front on the wearer) for the neckwear to essentially contour to the wearer's torso during body movements. This provides a level of comfort to the wearer. In other exemplary embodiments, a neckwear enables the wearer, without any key, tool or the like, to add, remove, or replace one or more torso segments, relocate one or more torso segments along the neckwear panel (below the neckband module), and/or switch the positions of two or more torso segments along the neckwear panel (below the neckband module). This intra-changeability feature results in an extensive number of potential neckwear combinations and appearances. Accordingly, the improved take-apart fasteners or the improved quick-release buckles enable a neckwear's torso segments to both pivot and be intra-changed with each other.

In some exemplary embodiments, the front of a neckband module and the front of all torso segments are rounded rectangles of the same planar size resulting in the front neckwear panel approximating a rectangle. In other exemplary embodiments, the front of a neckband module and the front all the torso segments are rounded squares of the same planar size. This feature of the neckband module and the torso segments all being the same width for a given neckwear maintains the symmetry of the neckwear regardless of which torso segments or how many torso segments are intra-changed. However, this invention is not limited in this way.

In other exemplary embodiments in which the neckband module and torso segments are metallic, the neckwear of the present application, in addition to other improvements, may include one or more of the following advantages as specifically compared to the fabric necktie: (1) stain resistant, (2) considerably easier and more economical to clean if soiled by food, beverages, ink, ashes from smoking, or other contaminants, (3) more durable, (4) wrinkle proof, (5) does not snag, (6) impervious to burn holes from smoking, (7) no need to tie a knot, and (8) more symmetrical to an observer when worn due to lack of necktie knot (and the resulting asymmetrical folds and crinkles below the necktie knot). Moreover, in some exemplary embodiments of neckwear that include torso-clip segment(s) that secure the neckwear to a shirt placket or front shirt panel, undesired movement of neckwear is curtailed. The neckwear remains substantially straight on the wearer and the torso-clip segments assist in covering all of the front shirt buttons during body movements. Given the metallic nature of such a neckwear, the pivoting capability that the instant fasteners provide the torso segments is an important feature for comfort. In some exemplary embodiments, the neckwear comprises a sufficient number of metallic torso segments so that the terminal torso segment of the neckwear ends approximately at the wearer's beltline, the traditional length of the necktie. In other exemplary embodiments, a neckwear includes a number of torso segments wherein the terminal torso segment does not end approximately at the wearer's beltline.

The present inventor discovered that an efficient exemplary method of providing extraordinary metallic neckband modules or metallic torso segments is to use a production process that is similar to that used by private and government mints to produce coins and pressed bullion bars. This pressing method results in very detailed and high quality designs in which any image, including color images, can be engraved and replicated on a neckwear panel. Moreover, this process is not only efficient for replicating a design on a large scale, but works well for low-volume customized production. A neckwear comprising a metallic neckband module and torso segments provided by a mint's pressing method showcases the beauty of metals and metalworking, and when worn, the neckwear provides dramatic contrast with the fabrics of shirts, vests and suitcoats in composition, texture, color and light reflectance value (LRV).

In another aspect, exemplary embodiments provide torso segments that have the capability to be added to a neckwear or to replace torso segments of a neckwear. In this regard, a torso segment that was not part of the original neckwear, a so called "extrinsic" torso segment, may be temporarily or permanently added to the neckwear. Should the wearer misplace or lose a torso segment, or simply wish to temporarily or permanently replace one or more torso segments with other torso segment(s), an exemplary embodiment includes providing additional and/or replacement "extrinsic" torso segments for use in a neckwear. It is understood that such additional and/or replacement "extrinsic" torso segments can attach at any torso-segment position of a neckwear having this feature, as both "intrinsic" torso segments that the neckwear comprised of originally and the "extrinsic" torso segments have uniform fasteners, or at least sufficiently uniform fasteners, providing the capability of connecting to each other. Extrinsic torso segments, also referred herein as interchangeable torso segments, may be commercially available as individual torso segments or as a plurality of torso segments.

In some embodiments wherein a neckwear comprises torso-clip segment(s), the present disclosure provides a neckwear that can be secured to a shirt placket or front shirt panel, without any additional accessories that are not already mounted to the neckwear, to curtail undesired movement of the neckwear while being worn including that the neckwear remains straight on the wearer and covers the front shirt buttons. In some embodiments, a neckwear includes at least one mounted torso-clip segment, which the wearer may or may not connect to his or her shirt.

As used herein, a "neckwear" includes a neckband, a neckband module, one or more torso segments, and one or more fasteners. In some embodiments, the torso segments are metallic, intra-changeable, and capable of pivoting.

"Neckband module" refers to the component of the neckwear to which torso segment one and the neckband connect.

"Torso segment" as used herein refers to the individual components that form the length of a neckwear originating from below the neckband module and to which torso segment one (the top most torso segment) connects to the neckband module. A neckwear comprises one or more torso segments. In some exemplary embodiments, one or more torso segments is intra-changeable. The term "torso-clip segment" as used herein means a torso segment which includes a mechanism, akin to a tie clip or the like, mounted on the backside of the torso segment.

"Neckwear panel" as used herein refers to the neckband module and the torso segments, collectively, of a neckwear. The term "front neckwear panel" means the front plane of the neckwear panel which is visible to the casual observer when the neckwear is worn.

"Instant fasteners" as used herein means the improved take-apart fastener and the improved quick-release buckle, collectively.

"Fastener" as used herein means any article or combination of articles used to connect, link, or join objects or portions of objects, including connecting, linking or joining a neckband to a neckband module and a neckband module to torso segment one and, if there is more than one torso segment, all of the torso segments of a neckwear to each other. Types of fasteners include for example, and in no way limiting, adhesives, aperture mechanisms that accommodate straps or the like, anchors, bolts, bayonet clasps, buckles, quick-release buckles, side-release buckles, center-release buckles, buttons, cables, catch, chains, clamps, clasps, clevis pins, clips, single end and double end swivels, deadeyes, eye bolts, hinges, including locking hinges, hinges with security pins, barrel hinges, take-apart hinges, and hinges that include hinge pins with, for example, external (male) thread which can be fastened into the hinge with, for example, internal (female) thread, hook-and-loop fasteners also known as hook-and-pile fasteners and Velcro®, hooks, lanyards, latches, locks, locking pins, magnetic locks or other magnetic mechanisms, loops, pins, rings, ropes, screw eyes, screws, snap hooks, snaps, spring fasteners, springs, straps, strings, swivel clips, ties, wires, zippers and any combination between or among the foregoing.

Exemplary embodiments of the instant neckwear include one or more fasteners to connect the neckband module and the torso segment(s). Examples of fasteners include any type of fastener that exhibits one or more of the following features. The first feature is a fastener that allows one or more torso segments to be quickly and easily intra-changed with other torso segments. The term "quickly and easily" as used herein, in the context of a neckwear, means any fastener that does not require any (extrinsic) key, tool or the like to add, remove, replace and/or relocate one or more torso segments, in terms of position along the neckwear panel (below the neckband module). The second feature, mainly for the wearer's comfort, is a fastener that enables torso segments to pivot (move from front to back and back to front on the wearer) in order for the neckwear to essentially contour to the wearer's torso during body movements and while sitting, including as the wearer goes from a standing position to a sitting position and vice versa. This feature of the exemplary neckwear affords a level of comfort to the wearer while maintaining the functionality of the necktie. The third feature is a fastener that allows the torso segments to effectively straighten out by gravity, without effort from the wearer of the neckwear, in order for the neckwear to become approximately parallel with the wearer's torso after body movements including, for example, when the wearer goes from a sitting position to a standing position. This feature avoids the necessity of the wearer straightening out the torso segments manually. Outside the context of a neckwear (for types of articles other than neckwear), the term "quickly and easily" as used herein means any fastener that does not require any (extrinsic) key, tool or the like to add, remove, replace and/or relocate segment(s) of an article or component(s) of an article such as a watchband or wristwatch.

"Comprised of originally" as used herein, in the context of a neckwear, means at the time of the initial sale, transfer, gift, or assignment of a neckwear into the wholesale or retail trade or in the event said sale, transfer, gift, or assignment of a neckwear into the wholesale or retail trade does not take place, the initial sale, transfer, gift, or assignment of the neckwear to the end user of the neckwear. Outside the context of a neckwear (for other types of articles), the term "comprised of originally" as used herein means at the time of the initial sale, transfer, gift, or assignment of an article into the wholesale or retail trade or in the event said sale, transfer, gift, or assignment of an article into the wholesale or retail trade does not take place, the initial sale, transfer, gift, or assignment of the article to the end user of the article.

The term "intra-changeable" including any other form of the word as used herein, in the context of a neckwear, means any one of the following three examples or any combination thereof: the capability of (a) two or more torso segments that a neckwear comprised of originally to be switched in terms of positioning along the neckwear panel (below the neckband module), (b) one or more torso segments that a neckwear comprised of originally to be relocated along the neckwear panel (below the neckband module), and/or (c) one or more torso segments that a neckwear comprised of originally to be detached and reattached to the neckwear. For example, each one of the nine torso segments of the neckwear in FIG. 1A may be intra-changed with every other of the eight torso segments, including for instance, the positions of torso segment three and torso segment seven may be switched. This entails detaching torso segments three and seven and attaching the previously numbered and positioned torso segment three in the place of the newly numbered and positioned torso segment seven and attaching the previously numbered and positioned torso segment seven in the place of the newly numbered and positioned torso segment three. Each of the nine torso segments in the embodiment of FIG. 1A is an "intra-changeable torso segment." Another example is that torso segment nine may be relocated as torso segment one, in which case, all the previously numbered and positioned torso segments change in that the previously numbered and positioned torso segment one is now torso segment two, the previously numbered and positioned torso segment two is now torso segment three, the previously numbered and positioned torso segment three is now torso segment four, et cetera. Yet another example of neckwear intra-changeability in the embodiment of FIG. 1A is that torso segment nine, for instance, may be detached from the neckwear without taking the position of another torso segment of the neckwear and may be reattached at a later time. Outside the context of a neckwear (for other types of articles), the term "intra-changeable" including any other form of the word as used herein means portions of an article that may be switched, relocated and/or detached (and may be reattached at a later time) in a manner similar to the (a), (b) and (c) examples above, as the case may be.

Of course, it is understood that a neckwear may contain any number of torso segments, including any of 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, et cetera torso segments; of which, none or any number of the collective number of torso segments of a neckwear may be intra-changeable torso segments. Similarly, and because the number of torso segments varies based on the size of the torso segments and other factors, including the wearer's preferences and the wearer's size which will differ from person to person, a neckwear may comprise a sufficient number of torso segments so that the neckwear ends approximately at the wearer's beltline.

"Contrast" including any other form of the word as used herein means the arrangement of opposite elements such as hard versus soft, light versus dark colors and rough versus smooth textures in a piece or ensemble to create visual interest, excitement and drama.

"Light Reflectance Value" (LRV) of an object means the percentage of light in the visible part of the spectrum that is reflected from its surface (and conversely the percentage of light the surface absorbs). LRV is measured using a integrating sphere reflectometer, the results of which run on a scale between 1 and 0 with a theoretical perfect white achieving a value of 1, reflecting 100 percent of visible light, and a theoretical perfect black achieving a value of 0, absorbing 100 percent. In practice, LRVs will not reach these theoretical limits.

Figure 1B:
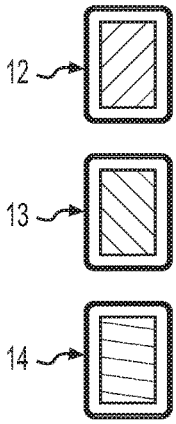
FIG. 1B is a frontal view of three, exemplary, extrinsic torso segments, which neckwear of FIG. 1A was not comprised of originally. Each extrinsic torso segment may be interchanged with every one of the nine torso segments said neckwear comprised of originally.

The term "interchangeable" including any other form of the word as used herein, in the context of a neckwear, means the capability to add one or more extrinsic torso segments that a neckwear was not comprised of originally to the neckwear or replace one or more torso segments that a neckwear comprised of originally with extrinsic torso segment(s) that the neckwear was not comprised of originally. For example, each of the extrinsic torso segments 12-14 in FIG. 1B (none of which the neckwear of FIG. 1A comprised of originally) may be interchanged with every one of the nine torso segments of the neckwear in FIG. 1A. Each of these three torso segments in FIG. 1B is an "interchangeable torso segment." Of course, extrinsic neckband modules or neckbands that a neckwear was not comprised of originally may also be interchanged with a neckband module or neckband that a neckwear comprised of originally. Outside the context of a neckwear (for other types of articles), the term "interchangeable" including any other form of the word as used herein, means the capability to add one or more extrinsic portions that an article was not comprised of originally to the article, or replace one or more portions that the article comprised of originally with extrinsic portion(s) that the article was not comprised of originally.

The term "mount" including any other forms of the word as used herein, means to connect a fastener to an article with the intention of the connection being on a permanent basis by any method including, for example, brazing or utilizing screws or bolts.

"Take-apart hinge" as used herein refers to a hinge with two hinge members that connect two objects and allows one or both objects to move or rotate and does not require any (extrinsic) key, tool or the like to separate the hinge members.

"Keyway" as used herein means a continuous channel on the first hinge member (male end) of the improved take-apart fastener which is configured and shaped to accommodate the key on the second hinge member (female end) of the improved take-apart fastener for the purpose of the key passing through the channel to lock or unlock the fastener. A keyway comprises at least one leg. A "leg" of a keyway as used herein means one portion of a keyway that ends at the intersection of a subsequent portion of a keyway, if any, and if the keyway has only one leg, the keyway ends at the point the key exits the keyway. For example, for a keyway comprising two legs, the first leg of the keyway starts at the key groove and ends at the intersection of the second leg of the keyway, and the second leg of the keyway ends at the point the key exits the keyway. A keyway may have any number of legs, including any number of 1, 2, 3, 4, 5, 6, 7 et cetera legs.

"Quick-release buckle" as used herein refers to side-release buckles, center-release buckles, and other buckles that include opposable, engagable and releasable buckle components. Quick-release buckles are also referred to as quick-connect buckles.

"Wristwatch" as used herein means a timepiece that is attached to a watchband such as a bracelet or strap and is worn around the wrist and wristwatch includes any smartwatch, activity tracker, or other wearable technology device that exhibits functionality that goes beyond timekeeping. In addition to decorative functions and the utilitarian function of holding a wristwatch to the wrist, a "watchband" as used herein includes bands that serve functions related to computing and wearable and wireless technology.

Neckwear

In some embodiments, a neckwear uses metal compositions for the neckband module and/or the torso segments and illustrative metals include silver, copper, gold, platinum, titanium, aluminum, iron, tin, alloys of the foregoing including bronze, brass, steel and pewter. Of course, torso segments or a neckband module may also be made from other metals or materials including natural polymeric materials also known as biopolymers including wood and rubber, synthetic polymers such as synthetic rubber, plastics and silicones, glass and glassy materials, and fiber reinforced polymers such as carbon-fiber reinforced plastics.

A frontal view of a connected neckwear in one embodiment is shown in FIG. 1A. The neckwear is worn similarly to a necktie with the neckband 11 positioned around the neck of the wearer and may be positioned under the collar. The neckband supports a metallic neckband module 10, which is situated at approximately the same position on the wearer as a necktie knot, and the metallic neckband module is connected to a series of nine metallic torso segments 1-9. Of course, it is understood that a neckband module or torso segments may be made from any suitable material, and a neckwear having a metallic neckband module and metallic torso segments is just one non-limiting example.

Identifying and numbering torso segments of any neckwear panel in the present disclosure is exemplified by the embodiment of FIG. 1A, in that, torso segment one 1 is below the neckband module 10, torso segment two 2 is below torso segment one, torso segment three 3 is below torso segment two, torso segment four 4 is below torso segment three, torso segment five 5 is below torso segment four, torso segment six 6 is below torso segment five, torso segment seven 7 is below torso segment six, torso segment eight 8 is below torso segment seven, and torso segment nine 9 is below torso segment eight. It is understood that a neckwear may have any number of torso segments, including any of 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40 et cetera torso segments; of which, none or any number of the collective number of torso segments of a neckwear may be pivoting torso segments. For any neckwear panel comprising greater than or less than nine torso segments, the sequential numbering of torso segment(s) follows the methodology described above for the embodiment of FIG. 1A.

It is further understood that FIG. 1A provides an exemplary nine torso-segment configuration and other configurations described herein are non-limiting examples. Since wearers of neckwear have different sized torsos and wearers prefer difference lengths of neckwear including that some wearers prefer the bottom of neckwear to end approximately at the beltline, the number of torso segments can be increased or decreased accordingly. For example, a tall person may prefer the neckwear in FIG. 1A to have thirteen torso segments whereas a petite person may prefer eight torso segments. Further, in other embodiments, the length of each torso segment dictates how many torso segments the neckwear may comprise. For example, for a given sized torso and a desire for the neckwear to end approximately at the beltline, the number of torso segments varies based on the length of the torso segments.

In the embodiment of FIG. 1A, the neckband module and the torso segments are rounded rectangles of the same planar size resulting in the front neckwear panel approximating a rectangle. The neckband module and each of the nine torso segments are approximately 3.49 cm wide by 5.08 cm high equating to the front neckwear panel of the neckwear measuring approximately 53.34 cm in length, including the spacing between the neckband module and torso segment one and between each of the subsequent torso segments. Each of the nine intra-changeable torso segments in FIG. 1A has a uniquely engraved symbol and each torso segment may be intra-changed with any of the other eight torso segments for an extensive number of neckwear appearances. The intra-changeability feature of the neckwear in this example equates to more than 350,000 neckwear combinations of the nine torso segments (9 factorial also recognized as 9!). This intra-changeability feature affords the wearer of this neckwear a wide variety of neckwear appearances.

Interchangeable torso segments provide even greater versatility and potential combinations to a neckwear and are configured to fit a neckwear accordingly. Examples of three interchangeable metallic torso segments 12-14 are shown in FIG. 1B. The center portion of the first interchangeable torso segment 12 may include, for example, blue enamel, the center portion of the second interchangeable torso segment 13 may include, for example, red enamel, and the center portion of the third interchangeable torso segment 14 may include, for example, green enamel. Each of the nine torso segments 1-9 in the embodiment of FIG. 1A may be replaced with any of the three interchangeable torso segments 12-14 in FIG. 1B and/or at least one of the three interchangeable torso segments may be added to the neckwear of FIG. 1A.

The exemplary metallic neckwear of FIG. 1A includes one or more of the following advantages, as compared to the fabric necktie and other types of neckwear resembling neckties: stain resistant and considerably easier and more economical to clean if soiled by food, beverages, ashes from smoking, ink or other contaminants, extensive intra-changeability and interchangeability, more durable, wrinkle proof, does not snag, impervious to burn holes from smoking, no need to tie a knot, more symmetrical to an observer when worn due to lack of necktie knot and the resulting asymmetrical folds and crinkles below the necktie knot, covers all of the front shirt buttons, and with torso-clip segments, undesired movement of neckwear is curtailed and neckwear remains straighter on the wearer.

In addition to aforementioned advantages of the exemplary metallic neckwear of FIG. 1A and for other embodiments of an illustrative neckwear made from metallic materials, the metal comprising a neckwear panel has permanent intrinsic value unlike disposable neckties that are discarded at the end of their life cycle since there will always be a market value for the constituent metals of a metallic neckwear. For example, a fine gold neckband module and fine silver torso segments of a neckwear may forever be sold at the spot price of these metals which may then be melted down and recycled. Moreover, a comfortable metallic neckwear provides a much needed formal and semi-formal fashion alternative to wearing a necktie or wearing a button-down dress shirt without a necktie.

Figure 2A:
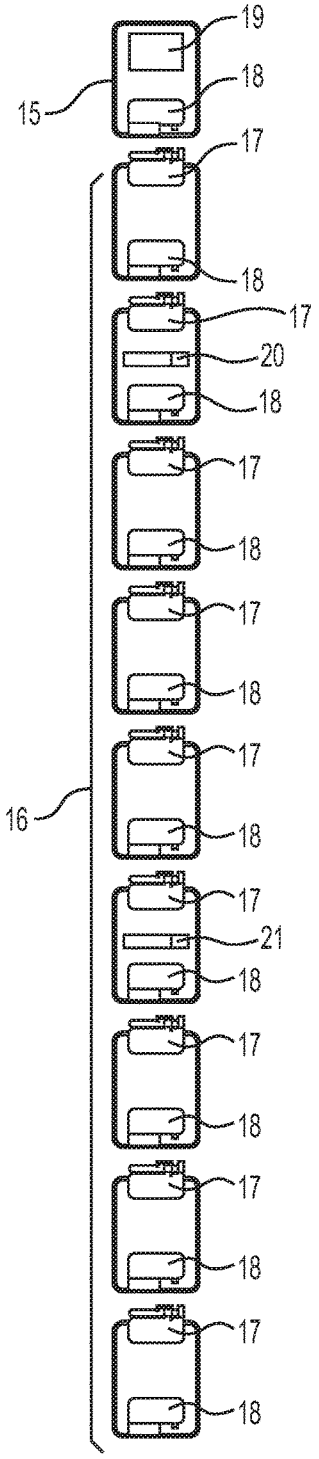
FIG. 2A is a rear view of the exemplary embodiment of FIG. 1A showing connectivity of the neckband module and nine intra-changeable torso segments with the instant improved take-apart fasteners. Said fasteners are connected and locked in FIG. 2B thereby connecting the neckwear panel.
Figure 2B:
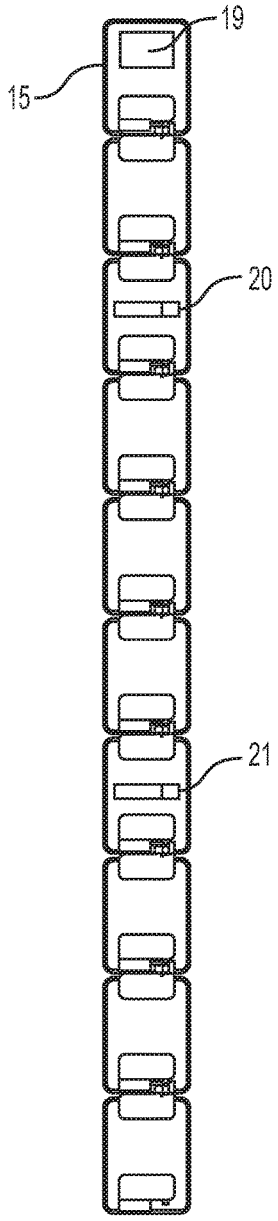

FIGS. 2A and 2B are rear views of the embodiment of FIG. 1A. FIG. 2A demonstrates the connectivity of a neckband module 15 and nine intra-changeable torso segments 16 with the instant improved take-apart fastener, which has two hinge members, a first hinge member (male end) 17 which includes a pin and a second hinge member (female end) 18 which includes a barrel. The first hinge member 17 and the second hinge member 18 are mounted to each of the nine torso segments and the second hinge member 18 is mounted to the bottom of the neckband module 15. Said improved take-apart fasteners have been unlocked and taken apart by separating the first hinge member and second hinge member as further described below. As shown in FIG. 2B, all improved take-apart fasteners have been put together and locked, as further described below, thereby connecting all components of the neckwear panel. The improved take-apart fastener includes all three aforementioned features of a fastener for a neckwear. As shown in FIGS. 2A and 2B, the rear of the neckband module 15 has a mounted aperture mechanism 19 which is an opening to accommodate the neckband and connect the neckband to the neckband module.

A neckwear may include at least one torso-clip segment to limit undesired movement of a neckwear panel, including to curtail the neckwear panel from swinging forward or moving from side to side on the wearer, to assist the neckwear to remain straighter on the wearer, as compared to a necktie and other types of neckwear resembling the necktie, and to cover the front shirt buttons while a neckwear is worn. In some embodiments, the torso-clip segment(s) secure the neckwear to a shirt placket or front shirt panel without any additional or unmounted accessories, and are quickly and easily intra-changed by the wearer of the neckwear, at his or her sole discretion, with any of the other torso segments offering the wearer of the neckwear a personalized fit. The factors determining how many torso-clip segments are utilized on the neckwear and the position to place the torso-clip segment(s) on the neckwear include the size and shape of the wearer's torso. For example, for comfort and a neat appearance the wearer may choose two torso-clip segments and place one torso-clip segment 20 at torso segment two and the other 21 at torso segment six as shown in FIGS. 2A and 2B. This feature of the wearer having the capability to choose the number of torso-clip segment(s) and the location of the torso-clip segment(s) anywhere along the neckwear panel (below the neckband module) is important for a customized fit, especially for a metallic neckwear. If the wearer of the neckwear opts two torso-clip segments, for example, and the wearer always places the torso-clip segments in the same positions such as at torso segment two and at torso segment nine, the aforementioned number of neckwear combinations in the embodiment of FIG. 1A is reduced accordingly. The wearer also has the option of not connecting any torso-clip segments even if the neckwear includes them.

Figure 3A:
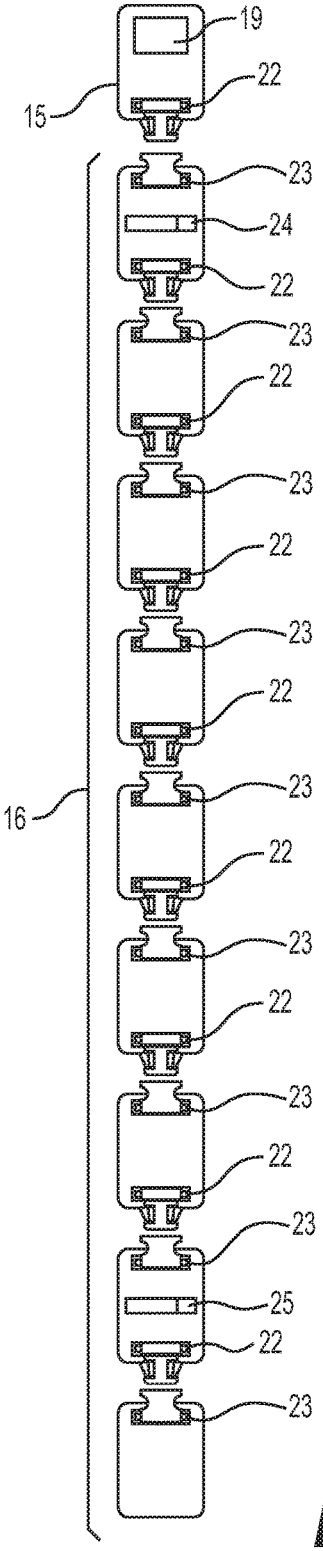
FIG. 3A is a rear view of an exemplary embodiment of a neckwear showing connectivity of a neckband module and nine torso segments with the instant improved quick-release buckles. Said buckles are engaged in FIG. 3B thereby connecting the neckwear panel.
Figure 3B:
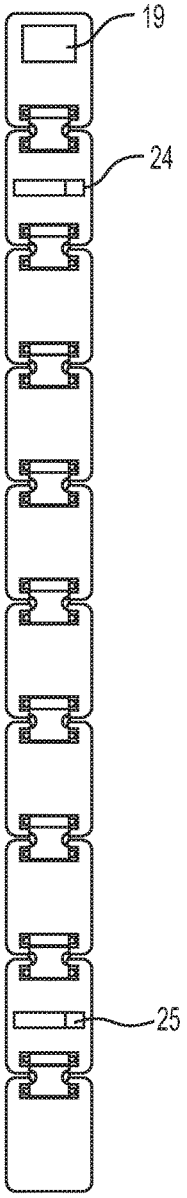

FIG. 3A is a rear view of an exemplary embodiment demonstrating the connectivity of a neckband module 15 and nine torso segments 16, including eight intra-changeable torso segments (torso segment one through torso segment eight), with the instant improved quick-release buckle. Each said buckle has two buckle members, a first buckle member (male end) which includes a center guide and a second buckle member (female end) which includes a receiving chamber. The first buckle member 22 and the second buckle member 23 are mounted to each of torso segment one through torso segment eight and the first buckle member 22 is mounted to the bottom of the neckband module 15 and the second buckle member 23 is mounted to the top of torso segment nine. The improved quick-release buckles have been unlocked by disengaging the first buckle member and second buckle member as further described below. As shown in FIG. 3B, all improved quick-release buckles have been locked by engaging the first and second buckle members, as further described below, thereby connecting all components of the neckwear panel. The instant improved quick-release buckle includes all three aforementioned features of a fastener for a neckwear. As shown in FIGS. 3A and 3B, the rear of the neckband module 15 has a mounted aperture mechanism 19 to accommodate the neckband and connect the neckband to the neckband module and two torso-clip segments 24, 25 have been placed at torso segment one and torso segment eight.

It will be appreciated that mounting a member or portion of any fastener toward the bottom of a terminal torso segment of any embodiment of a neckwear is optional. For example, in the embodiment of FIGS. 3A and 3B, the first buckle member 22 of the improved quick-release buckle toward the bottom of torso segment nine (terminal torso segment in this example) has not been included. The primary purpose of mounting said first buckle member is to allow torso segment nine to be intra-changeable with each of the other eight torso segments. Not including said first buckle member reduces the number of potential neckwear combinations accordingly. In a modified embodiment of FIGS. 3A and 3B, the first buckle member of the improved quick-release buckle is included toward the bottom of torso segment nine.

The composition of the aperture mechanism on the neckband module may be a variety of suitable materials, including metals, metal alloys including steel, wood, fiber reinforced polymers and synthetic polymers such as plastics. An aperture mechanism may also be provided as part of a casting of the neckband module or may be provided by other methods. If not part of such a casting, the aperture mechanism may be, for example, bolted to the neckband module. It will be appreciated that an aperture mechanism may be any size or shape other than the rectangular shape of the aperture mechanism 19 shown in FIGS. 2A, 2B, 3A and 3B. Other configurations, including an aperture mechanism with a curvature, may be more suitable for a given neckband type or composition.

The present inventor discovered that an efficient method of providing extraordinary metallic neckband modules or metallic torso segments for a neckwear of the present disclosure is the pressing method that private and government mints use to produce coins and pressed bullion bars. The pressing method of providing components of a neckwear panel imparts many advantages, as compared to other methods, including the capability of producing exquisitely detailed designs with high quality finishes on a neckband module or torso segment equivalent to the level of detail and quality of bullion bars or collector coins produced by mints. These finishes include matt, proof, and reverse proof. For example, a proof torso segment, production methods of which are well known in the art that include highly polished dies, comprises a frosted appearance on the higher fields of the surface of the torso segment and a mirror-like finish on the lower fields of the surface of the torso segment. Metallic torso segments or metallic neckband modules provided by the pressing method may also be struck in high relief or ultra-high relief. The images on high relief metallic torso segments and metallic neckband modules of the present disclosure, like high relief coins and bullion bars, generally extend above the outer edges of the torso segments and neckband modules and these medallions struck in ultra-high relief result in images that rise even higher. Popular examples that have been produced by the United States Mint include the 2015 high-relief liberty gold coin and the 2009 ultra-high relief gold double eagle. High relief and ultra-high relief coins and medallions elevate the level of detail that can be seen and felt on the image and are sometimes described as works of art rather than coins or medallions. Another advantage of providing metallic torso segments and metallic neckband modules, as compared to other methods, by the pressing method is that multiple levels of relief may be achieved. For example metallic torso segments and metallic neckband modules may include "3-dimensional" designs resulting from the artwork being sculpted in contoured multi-level relief.

Metal blanks are required in the pressing method and are provided by melting down the desired metal or metal alloy and emptying the molten metal into billets. The heated billets then proceed through an extruder which operates under extreme pressure to fashion the heated forms into thin strips of soft annealed metal. After the long thin strips of extruded metal have cooled, they are trimmed and may be done so using a hydraulic shearer and then rolled by a high pressure rolling machine until an exact desired thickness is achieved. From the rolled strips, a blanking press then punches out metal blanks to the size and shape desired for the neckband module and the torso segments to be subsequently engraved. The blanks are then cleaned and polished and may be done so in a vibratory finishing machine. Before the engraving dies are produced to engrave or strike the blank metal neckband modules and the blank metal torso segments with the desired designs and information, three-dimensional plaster sculptures of the desired designs and information are made. The sculpture is rendered in relief and is mechanically reduced by a reducing lathe in the production of the engraving dies which are typically hardened steel. The dies are a reverse engraving of the sculpture and once produced, the polished blanks are firmly secured in a collar inside the minting press between the bottom and top dies. With each strike of the press, the impact of the dies on the blank within the collar forces the metal into the alcoves of the dies and engraves the neckband module and the torso segments with the desired design and information on each side. In some embodiments, the edges of the neckband module and torso segments may also be engraved with desired designs and information which may include hallmarking.

In other embodiments, in which the neckband module or torso segments are made from metallic materials, methods of pouring metal provide the neckband module or torso segments of the instant neckwear. Pouring methods, which have been used for millennia, includes heating and melting the metal or metal alloy and pouring the melted metal into a mold or cast to form the desired shape of a neckband module or torso segment. Generally, there is greater control over quality, finishes, and uniformity including weight, with bullion bars provided by the pressing method as compared to bullion bars provided by pouring methods.

It will be appreciated by those skilled in the art that the temperatures, pressures, timeframes and other particulars utilized in the pouring method and pressing method depend on the specific metal or metal alloy of a neckband module or torso segments being produced. For example, silver melts at approximately 962° C. and has a Vickers hardness of approximately 251 MPa whereas platinum melts at approximately 1,768° C. and has a Vickers hardness of approximately 400-550 MPa.

Millesimal fineness is a system of denoting the purity of metals by parts per thousand of a pure metal in the alloy by mass. The millesimal fineness of "fine silver" is generally 999 fine (99.9% pure), also referred to as, three nines fine. Fine gold, fine silver and fine copper each has a unique and appealing color, which is altered when any of these metals is alloyed with another metal. Fine gold is cherished due to its color and has a more yellowish tone than 14 karat gold (58.33% gold). The color of fine silver is brighter than silver alloys including sterling silver. Copper, like gold, is one of the few metallic elements with a natural color other than gray or silver.

An individual neckband module or torso segment may be comprised of multiple materials such as wood and metal. A neckwear panel may be comprised of multiple materials such as multiple types of metals or wood and metal. For example, the neckband module may be copper and the torso segments may be fine silver, any of which may include engravings and/or enamels.

Add-on design elements or symbols for the front neckwear panel, including the ten exemplary symbols on the front neckwear panel in FIG. 1, may be provided by various methods. For example, said ten symbols are easily and efficiently engraved onto metallic torso segments or a metallic neckband module by the pressing method as described herein. Alternatively, said ten symbols may be provided by a separate method such as by the pouring method and then mounted to the neckband module or torso segments. Instead of mounting, a less permanent method of fastening may be utilized to facilitate the wearer changing the add-on design elements or symbols. Add-on design elements or symbols can be contrasting metals creating a dramatic fashion appearance. For example, a front neckwear panel comprised of fine silver may include symbols comprised of fine gold that are mounted to the front neckwear panel.

To add further color to a metallic neckwear panel, a metallic neckband module or metallic torso segments may include plating, enamels, porcelains, paints, and inks such ink overlays that provide colorized portraits virtually duplicating a digital image or photograph. For example, gold plate may be applied to selected areas of an engraved design on silver neckband modules or silver torso segments. To add designs to a metallic neckwear panel, a metallic neckband module or metallic torso segments may include inscriptions, engravings, sculptures, etchings or other design elements from other known methods in the art. Neckband modules and torso segments may also include any design element of any method to display, promote, proclaim or represent, for example, artistic themes, musical themes or bands, books, movies, casts, cartoons, action figures, cites, states, countries, historical events or figures, mythological figures, ethnic or national heritage, family members, movements, political parties, law, religion, science, symbols, schools, universities, professions, organizations, trades unions, trade groups, companies, industries, corporate affiliations, trademarks, logos, clubs, proverbs, slogans, sports or sports teams, holidays, special events and personal experiences. Non-metallic neckband modules and torso segments or portions thereof may include the foregoing color and design elements not specific to metals.

A neckband of the disclosed neckwear may be adjustable to comfortably fit various size necks and may include a strap or the like and a fastener to attach and/or adjust the circumference of a neckband. A neckband supports the neckband module and the neckband may be from a multitude of suitable materials. Suitable materials for a flexible neckband strap include leather, nylon or fabric such as silk. For example, leather neckbands, similar to belts, have various holes on the strap allowing the wearer to place the prong of a buckle through any hole along the strap for optimal comfort and appearance. Various types of fasteners known in the art may be utilized in conjunction with the neckband strap, including those used for neckbands and belts. For example, suitable fasteners include buckles, quick-release buckles such as side-release buckles and center-release buckles and hook-and-loop fasteners such as Velcro®. Suitable materials for a neckband fastener to accommodate the strap (or the like) are metals including aluminum, metal alloys such as steel, fiber reinforced polymers and synthetic polymers including plastics. It will be appreciated that the neckband may comprise of non-flexible materials, including metallic materials, as an alternative to a flexible neckband strap. For example, types of chains or necklaces such as a rigid choker comprising two approximate half-circle sections which open and close by a hinge and said sections are secured around the wearer's neck with a fastener to form a circle or oval.

A neckband module, including an aperture mechanism, and torso segments of a neckwear may also be provided by other methods known in the art including three-dimensional printing (3D printing), also known as additive manufacturing (AM). "3D printing" or "AM" as used herein refers to various processes used to synthesize a three-dimensional object, including the means of producing an object through successive or multiple layers of material formed under computer control from a model or other electronic data source. Many types of 3D printing may be utilized for the inventive neckwear, including powder bed and inkjet head 3D printing (3DP), electron-beam melting (EBM), selective laser melting (SLM), direct metal laser sintering (DMLS), directed energy deposition, electron beam freeform fabrication (EBF) and robocasting.

Figure 4:
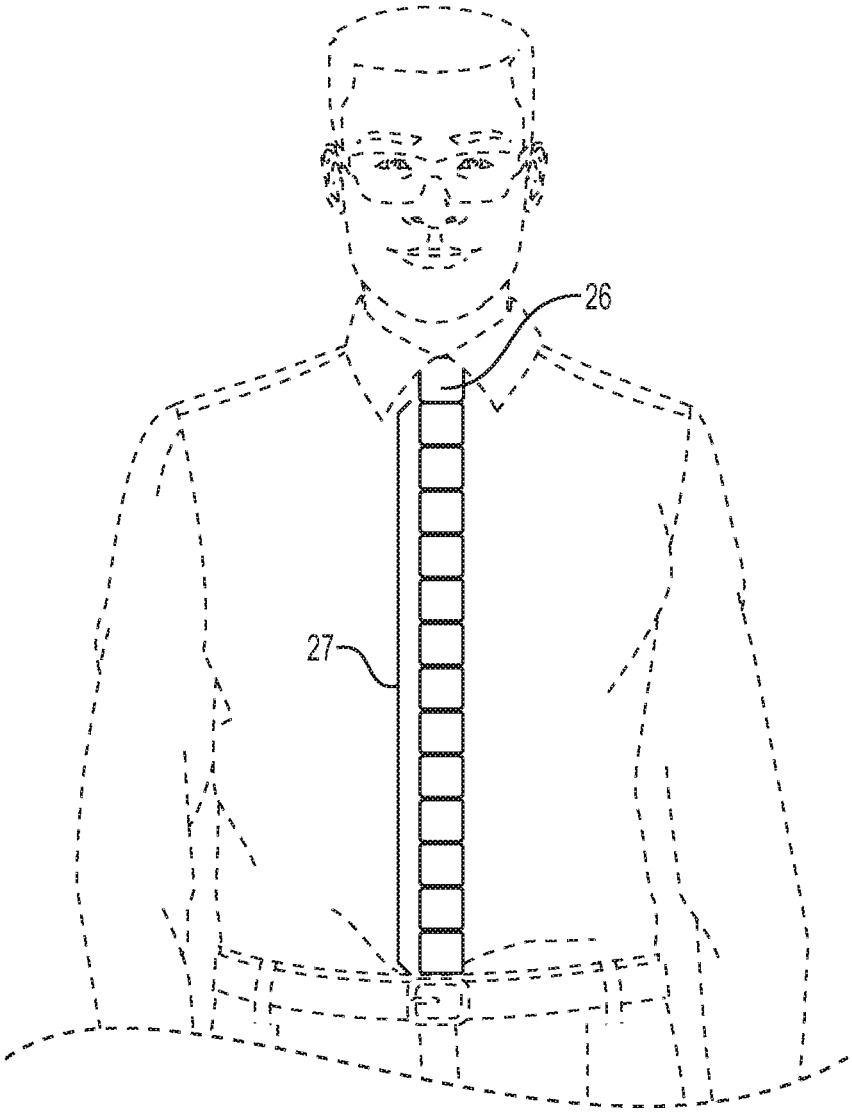
FIG. 4 is a frontal view of an exemplary embodiment of a neckwear, including a neckband, a neckband module and thirteen rounded-square torso segments, worn by a gentleman.

Another exemplary embodiment of a neckwear is shown in FIG. 4, which includes a neckband, a rounded-square neckband module 26 and thirteen, intra-changeable, rounded-square torso segments 27 worn by a gentleman. The neckwear is worn similarly to a necktie with the neckband positioned around the neck of a gentleman and under his shirt collar. The bottom of torso segment thirteen ends at approximately the beltline which has traditionally been the length preference of the modern necktie. The neckband module and the torso segments are rounded squares of the same front planar size resulting in the front neckwear panel approximating a rectangle. The neckband module 26 and the thirteen torso segments 27 are approximately 3.49 cm squared resulting in the front neckwear panel of the neckwear measuring approximately 51.5 cm in length including the spacing between the neckband module and the torso segment one and between each of the subsequent thirteen torso segments. The intra-changeability feature of the neckwear in this embodiment equates to more than six billion neckwear combinations of the thirteen torso segments (13 factorial also recognized as 13!). This intra-changeability feature affords the wearer of this neckwear a wide variety of neckwear appearances. If the wearer of the neckwear opts to connect, for example, two torso-clip segments and the wearer always places the torso-clip segments in the same positions such as at torso segment four and at torso segment nine, the aforementioned number of neckwear combinations in the embodiment of FIG. 4 is reduced accordingly.

In some embodiments, including each exemplary embodiment of FIGS. 1 and 4, the neckband module and the torso segments of a neckwear are all the same width. This advantageous feature of the instant neckwear allows every one of the torso segments to be intra-changed while the front neckwear panel remains symmetrical. Maintenance of the neckwear's symmetry, regardless of which torso segments are intra-changed or how many torso segments are intra-changed, is a functional feature of the neckwear as well as an aesthetic feature emphasizing symmetry. In other embodiments, a neckband module may not be the same width as any of the torso segments. However, the smaller the neckband module, the greater the comfort level of the neckwear. Therefore, in conjunction with pivoting torso segments, narrow and thin (from front to back) neckband modules, including those in FIGS. 1 and 4, impart advantages of an increased comfort level of the instant neckwear, as compared to more voluminous necktie knots or other large articles at or near the throat area of other types of neckwear.

Figure 5:
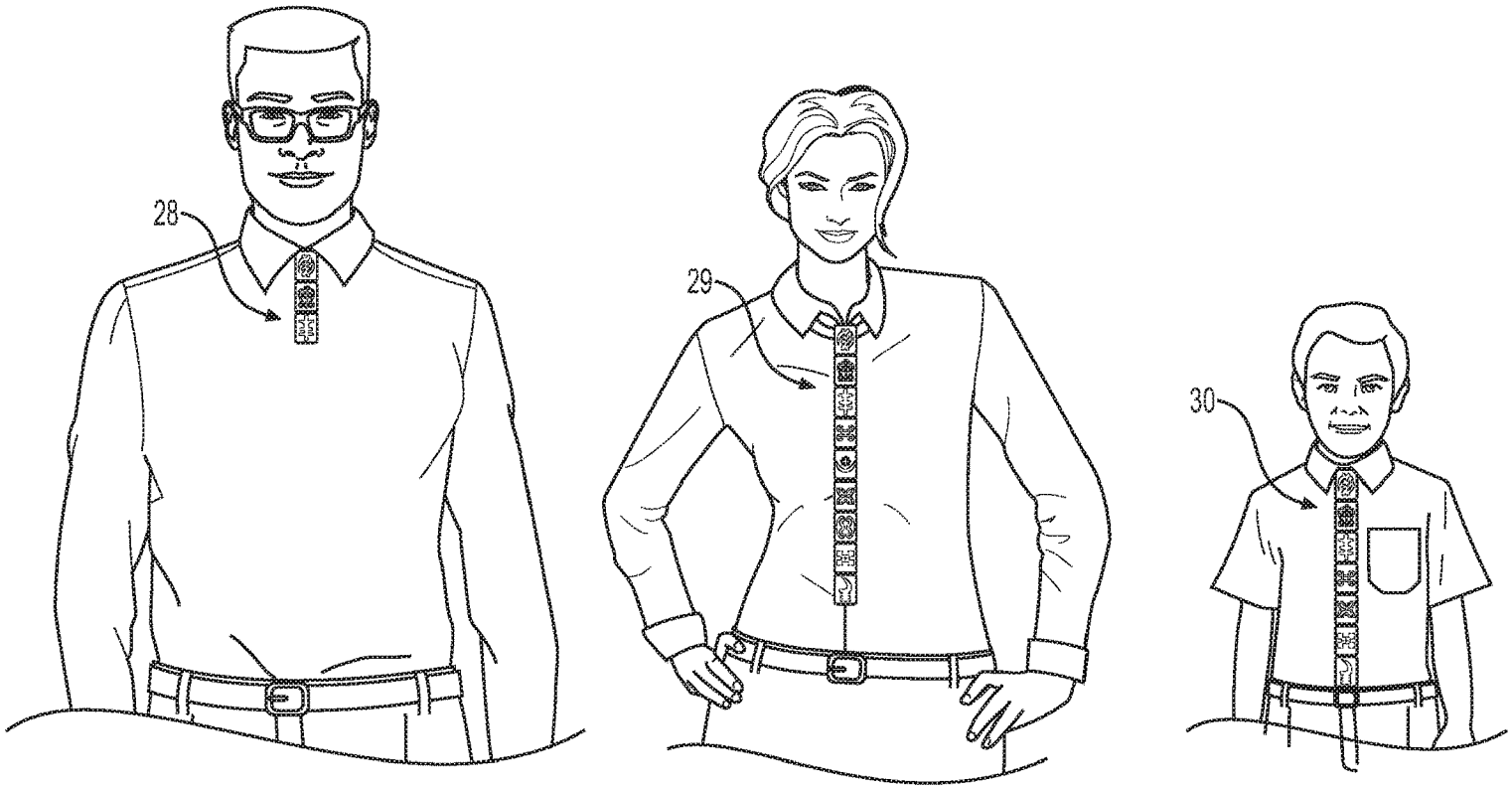
FIG. 5 is a frontal view of three exemplary neckwear configurations of the neckwear of FIG. 1A. The first neckwear is worn by a man including the neckband module and two of the nine torso segments. The second neckwear is worn by a woman including the neckband module and eight of the nine torso segments. The third neckwear is worn by a boy including the neckband module and six of the nine torso segments.

The instant neckwear may be worn at various lengths depending on the wearer's preference. Torso segments are easily added, removed or replaced and, in terms of their position along the neckwear panel (below the neckband module), may be relocated or switched. FIG. 5 illustrates the neckwear of FIG. 1A worn in three different configurations: by a man with two torso segments 28, a woman with eight torso segments 29 and a boy with six torso segments 30. This feature, unlike the standard necktie and other types of neckwear resembling the necktie, renders the instant neckwear quite versatile and accommodating to a wide variety of people including people of both sexes and multiple sizes and age groups from children on up. If the wearer's preference is for the neckwear to end at approximately the beltline, the number of torso segments varies based on the wearer's size and the size of the torso segments.

Figure 6A:
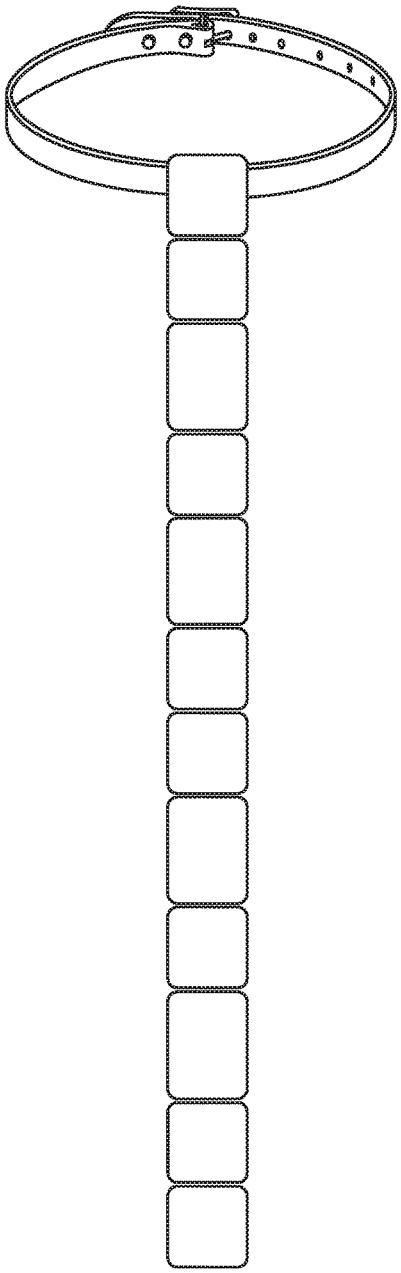
FIG. 6A is a frontal view of an exemplary embodiment of a neckwear, wherein the neckwear panel includes a combination of shapes, namely rounded squares and rounded rectangles.
Figure 6B:
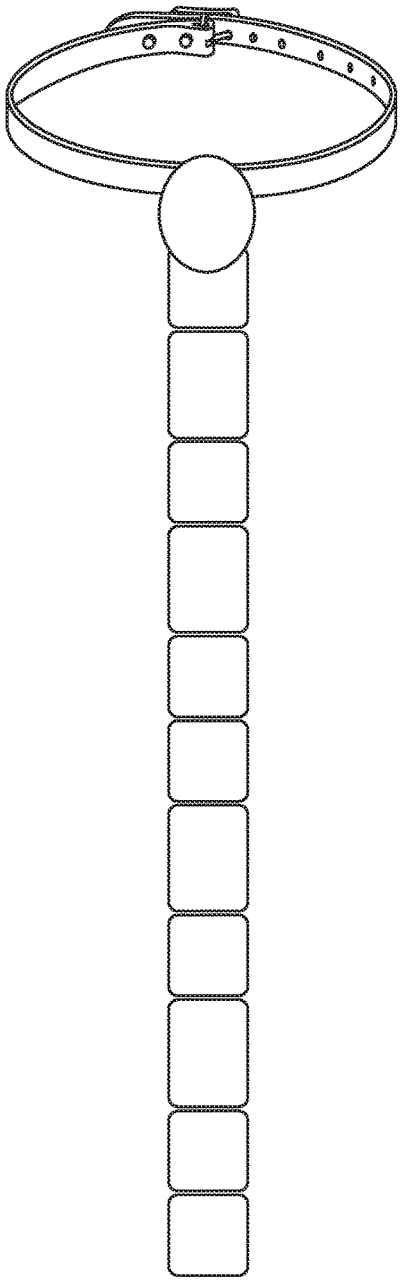
FIG. 6B is a frontal view of an exemplary embodiment of a neckwear, wherein the neckwear panel includes a combination of shapes, namely an oval, rounded squares and rounded rectangles.

The neckband module or torso segments of a neckwear may be of any shape or size including rounded squares, squircles, squares, rounded rectangles, rectangles, ovals, circles, triangles, pentagons, hexagons, heptagons, octagons et cetera. In some embodiments, a neckwear panel may include torso segment(s) of various sizes, including various widths and/or shapes. For example, as shown in FIG. 6A, an exemplary neckwear panel includes a combination of rounded squares and rounded rectangles. As shown in FIG. 6B, an exemplary neckwear panel includes a combination of rounded squares, rounded rectangles and an oval neckband module. In another exemplary embodiment, a neckwear panel includes a circular neckband module and all circular torso segments.

Light reflectance in the visible spectrum (hemispherical directional reflectance at wavelength intervals of 10 nanometers (nm) from 390 to 700 nm, one angle, less than 20°) was analyzed by Surface Optics Corporation using a Cary 5000 integrating sphere reflectometer on three metallic torso segments, three button-down dress shirts and three fabric neckties. The three torso segments provided for analysis were designed by Patuga LLC and manufactured by a private mint utilizing the pressing method. All three torso segments analyzed for light reflectance are comprised of all metal and do not comprise of any enamel or post-engraved design elements. One of the torso segments is fine silver, the second is fine copper, and the third is brass (85% copper and 15% zinc). All three torso segments have the identical design and engraving as the torso segments in FIG. 1B including the same minted proof finish as described above.

The three button-down dress shirts provided for light reflectance value (LRV) analysis were Stafford branded shirts, distributed by J.C. Penny Corporation in the United States of America (Travel, Easy-Care Broadcloth, comprised of 55 percent cotton and 45 percent polyester, regular fit size –16½, 32-33). Each of the three dress shirts was a solid color; the first was blue (labeled, blooming blue), the second was white (labeled, white) and the third was grey (labeled, rockefeller grey). The three fabric neckties provided for LRV analysis were J F J. Ferrar branded neckties, distributed by J.C. Penny Corporation, (narrow JF Backwall). Each of the three neckties was a solid color; the first was blue (labeled, extreme blue), the second was red (labeled, cayenne) and the third was yellow (labeled, bright buttercup). The label of the subject neckties did not disclose the type of fabric. All three neckties had a robust sheen.

All dress shirts and neckties analyzed were a solid color without any type of noticeable pattern on the fabric so there would be no ambiguity or issue when choosing a target location on the samples with the spectrophotometer if the fabrics, for example, included multiple colors or patterns. The target location on each sample for the spectrophotometer to analyze light reflectance was approximately 3 cm by 5 mm. The center of the target location on each of the three types of samples were as follows: for the torso segments, 3 mm from the top (as positioned on a neckwear) and centered from left to right, for the shirts, 2 cm below the tip of left the collar (while the shirts were still folded and pinned from the factory so that the fabric of the target location of each shirt was multi-layered), and for the neckties, 38 cm from the bottom tip of the necktie and centered from left to right.

Figure 7:
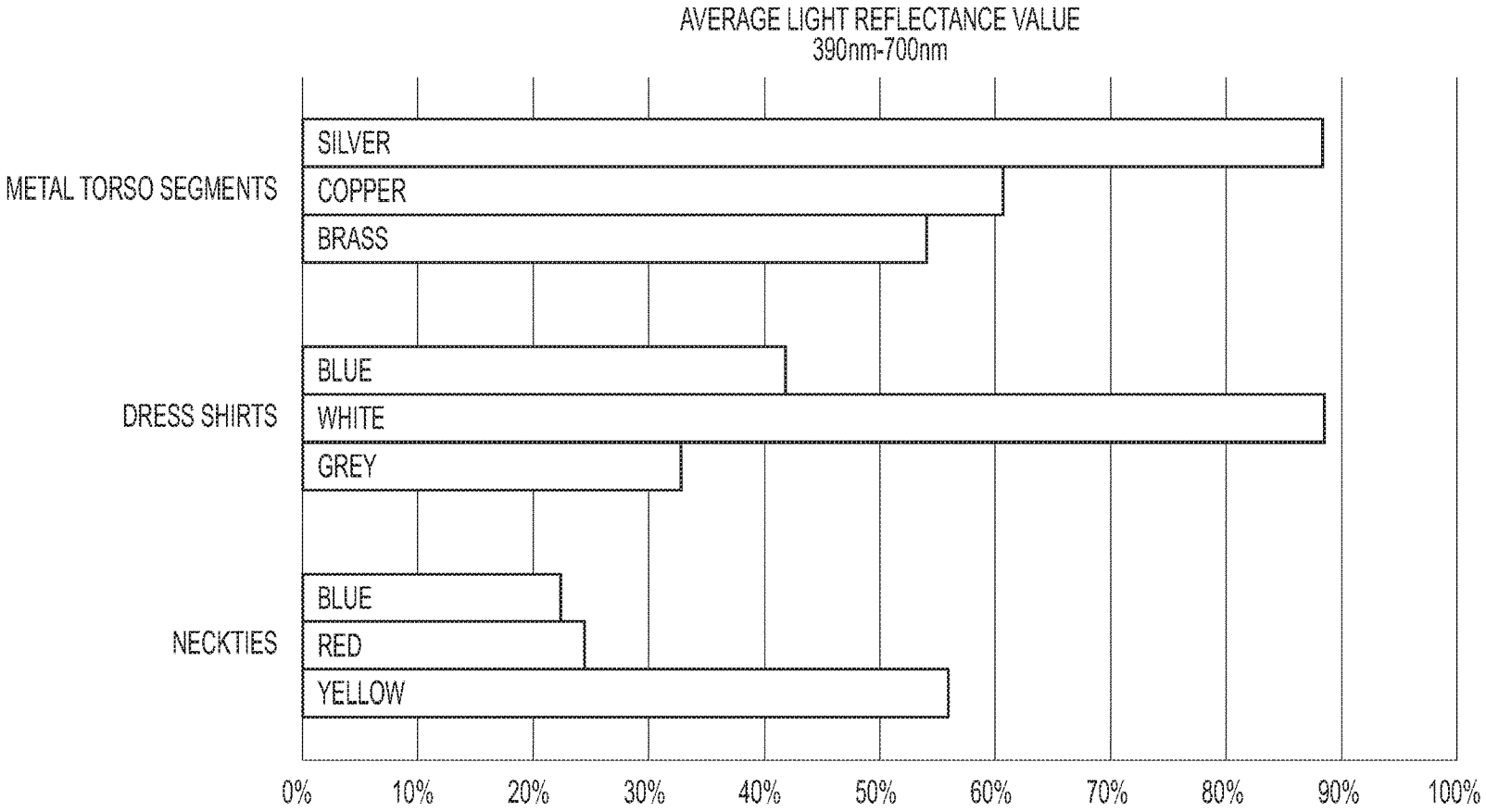
FIG. 7 is a bar graph depicting light reflectance values of three metallic torso segments, three dress shirts and three neckties.

Thirty-two light reflectance values were generated from each of the nine samples. The average of these thirty-two values for each of the nine samples is depicted in a bar chart in FIG. 7. The average LRV of the silver torso segment (88.5 percent) was approximately equal to the average LRV of the white dress shirt (88.6 percent), which is remarkable that a metal reflects light as well as a white object. The average LRV of the silver torso segment (88.5 percent) was greater than the average LRV of the blue shirt (32.8 percent) and greater than the average LRV of the grey shirt (42.0 percent) and greater than the average LRV of all three neckties (blue: 22.5 percent, red: 24.6 percent and yellow: 56.2 percent). The average LRV of the copper torso segment (60.9 percent) was greater than the average LRV of the blue shirt (32.8 percent), greater than the average LRV of the grey shirt (42.0 percent) and greater than the average LRV of the all three neckties. The average LRV of the brass torso segment (54.1 percent) was greater than the average LRV of the blue shirt (32.8 percent), greater than the average LRV of the grey shirt (42.0 percent), approximately equal to the average LRV of the yellow necktie (56.2 percent), and greater than the average LRV of the blue necktie (22.5 percent) and greater than the average LRV of the red necktie (24.6 percent). These LRV results affirm that a neckwear comprising a metallic neckband module and/or metallic torso segments provided by the pressing method of a mint contrasts dramatically with fabrics of formal and semi-formal attire not only in color, composition and texture, but also in light reflectance. Metallic neckwear of the present disclosure, as part of formal and semi-formal attire, generates visual interest, excitement and drama.

Improved Take-Apart Hinges

In another aspect, the present inventor devised new and improved take-apart hinges, referred herein an improved take-apart fasteners. The inventor identified a need for better securing an object using a take-apart hinge that has a greater level of security including increased theft deterrence and a reduced probability of the hinge inadvertently unlocking and sliding apart by random movement or impact. In one embodiment, the instant improved take-apart fastener may be utilized in the instant neckwear for securing components of the neckwear panel. In other embodiments, the instant improved take-apart fastener may be used for securing or quasi-locking an article to an object, such as securing a piece of art or securing valuables like jewelry to a display in a retail environment. In this way, the improved take-apart fastener can provide increased security and assist in preventing theft.

Take-apart hinges, sometimes referred to as "lift off hinges," are well known in the art. They function similarly to typical hinges by connecting two objects and allowing one or both objects to move or rotate. Advantageous features of take-apart hinges are that an object connected to a take-apart hinge is disconnected and/or reconnected without any key, tool or the like and take-apart hinges are strong relative to their size in terms of handling force and weight loads.

Figure 8A:
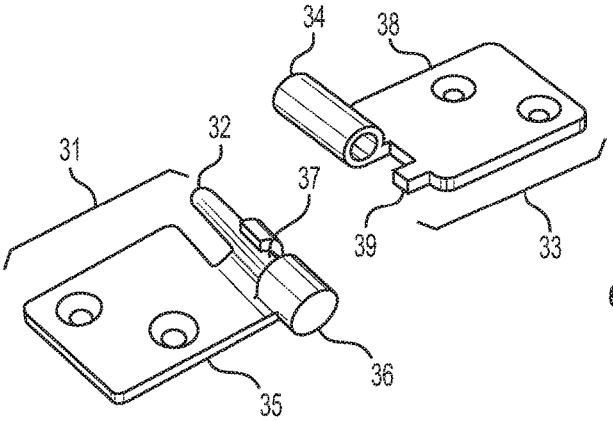
FIG. 8A (PRIOR ART)
FIG. 8A is a top view of a prior-art take-apart hinge that has been unlocked and taken apart.
Figure 8B:
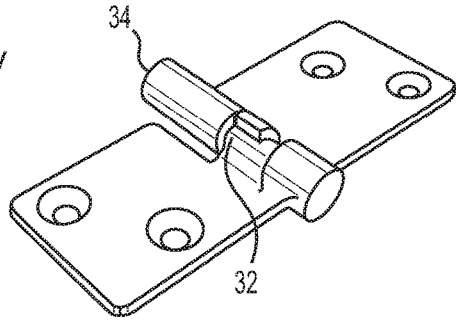
FIG. 8B (PRIOR ART)
FIG. 8B is a top view of said hinge in the locked position.
Figure 8C:
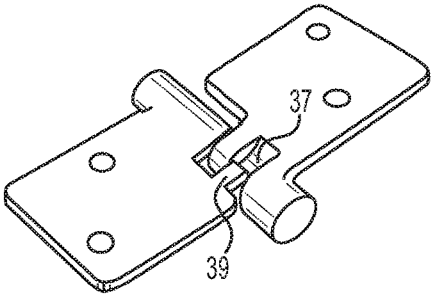
FIG. 8C (PRIOR ART)
FIG. 8C is a bottom view of said hinge in the locked position.
Figure 8D:
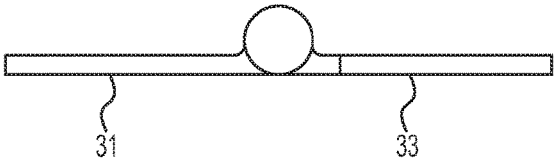
FIG. 8D (PRIOR ART)
FIG. 8D is a side view of said hinge in the locked position.

A typical, previously known take-apart hinge, Sea Dog Line made in Thailand, is cast stainless steel and shown in FIGS. 8A-8F. FIG. 8A is a top view of the prior-art take-apart hinge that has been unlocked and taken apart and consists of two members, a first hinge member (male end) 31 with a pin 32 and a second hinge member (female end) 33 with a barrel 34 which receives and houses the pin and acts as the pivot point. The first hinge member comprises a first leaf 35, a knuckle 36, a key groove 37, and a pin 32. The second hinge member comprises of a second leaf 38, a key 39 and a barrel 34. FIG. 8B is a top view of the prior-art take-apart hinge in the locked position showing the pin 32 is engaged with the barrel 34. FIG. 8C is a bottom view of said hinge in the locked position showing the key 39 is engaged with the key groove 37. FIG. 8D is a side view of said hinge in the locked position revealing that the bottom of the hinge is flat and straight across the first hinge member (male end) 31 and the second hinge member (female end) 33.

Figure 8E:
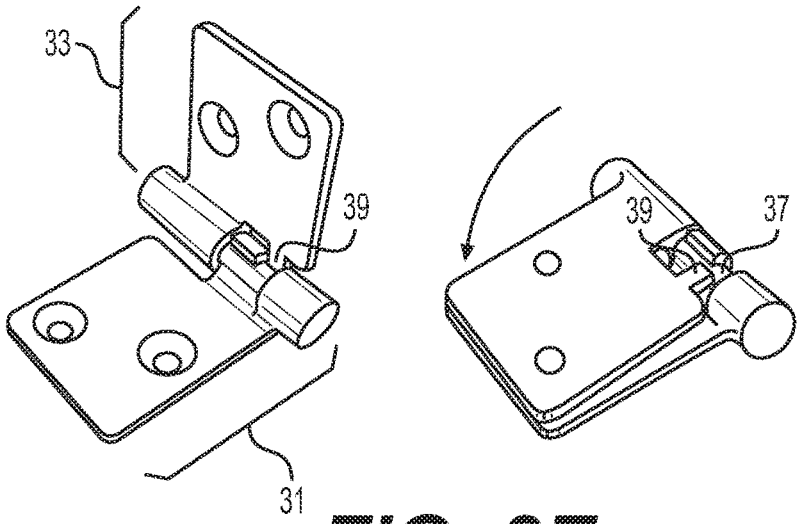
FIG. 8E (PRIOR ART)
FIGS. 8E and 8F illustrate the steps of unlocking and taking apart said hinge.
Figure 8F:
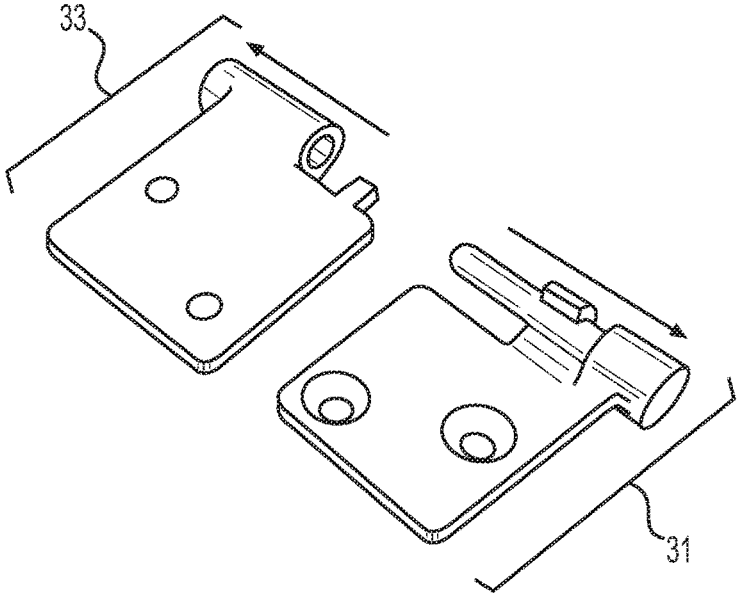
FIG. 8F (PRIOR ART)

Unlocking and taking-apart the prior-art take-apart hinge requires two steps. First, as compared to the flat position of the hinge in FIG. 8D, rotate (close from flat position) the hinge to the correct angle (at least approximately 150°) allowing the key 39 on the female end 33 to free itself from the key groove 37 on the male end 31, as illustrated in FIG. 8E. The key 39 is no longer constrained within the key groove 37 and both the male end 31 and the female end 33 are now unlocked. Second, as illustrated in FIG. 8F, slide apart the male end 31 and female end 33. To lock the hinge these two steps are performed in reverse order.

Although said hinge is sufficient for certain applications and is strong when locked due to its composition and design, due to how easy said hinge unlocks, it is not adequate for applications requiring safeguards against disconnecting unintentionally, for example, by random movement or impact. These characteristics also make said hinge not practical or suited for applications requiring a theft deterrent.

Figure 9A:
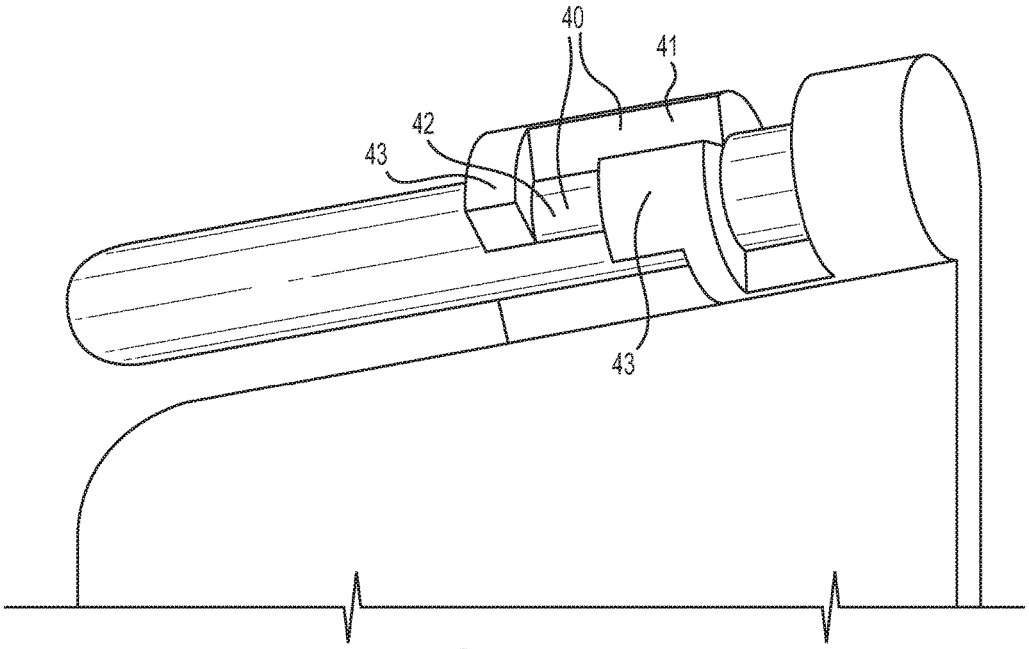
FIG. 9A is an enlarged top view of an exemplary embodiment of a keyway incorporated on the first hinge member of an improved take-apart fastener.
Figure 9B:
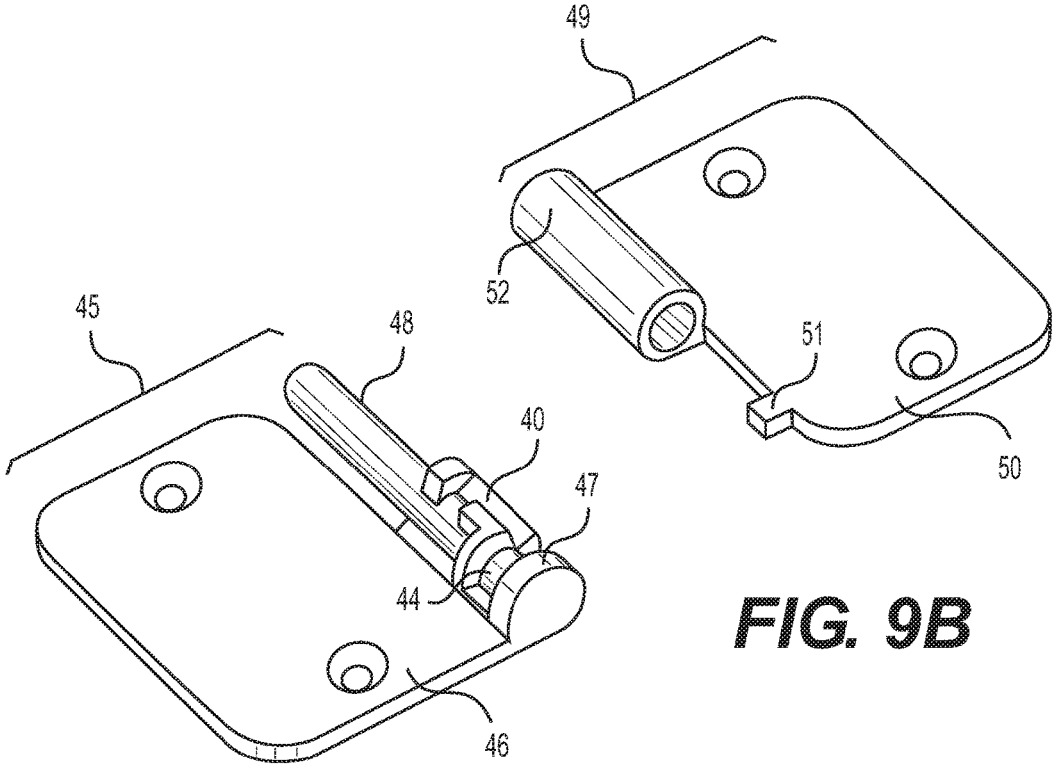
FIG. 9B is a top view of said fastener that has been unlocked and taken apart showing the first hinge member (male end) separately from the second hinge member (female end).

The instant improved take-apart fastener, which may be made by any method well known in the art including being cast with stainless steel, adds an important feature of additional security to the prior-art take-apart hinge described above. Examples of the improved take-apart fastener are shown in FIGS. 9A-9I. A keyway 40 consisting of two legs, a first leg 41 of the keyway and a second leg 42 of the keyway, has been incorporated on the first hinge member (male end) of the improved take-apart fastener as shown in FIG. 9A. The keyway, configured by elevated curls 43 on the pin, is a channel to engage the key. As further described below, since the key must be guided through the keyway for the hinge to lock and unlock, the incorporation of a keyway increases theft deterrence and greatly reduces the probability of the hinge inadvertently unlocking and sliding apart. The keyway 40 on the male end 45 of the improved take-apart fastener in FIG. 9B is separate and distinct from the key groove 37 on the prior-art take-apart hinge in FIG. 8A and separate and distinct from the key groove 44 on the male end 45 of the improved take-apart fastener in FIG. 9B. The prior-art take-apart hinge does not comprise a keyway; therefore, upon the key of said hinge exiting the key groove, both hinge members of said hinge are unlocked and may be immediately taken apart.

As shown in FIG. 9B, the improved take-apart fastener comprises a first hinge member (male end) 45 and a second hinge member (female end) 49. The first hinge member 45 comprises a first leaf 46, a keyway 40, the key groove 44, a knuckle 47, and the pin 48. The second hinge member 49 comprises a second leaf 50, a key 51 and a barrel 52. The first leaf 46 and the second leaf 50 each has holes to accommodate bolts or screws for mounting the improved take-apart fastener to objects. The knuckle 47 serves as the outside boundary of the key groove 44.

Figure 9C:
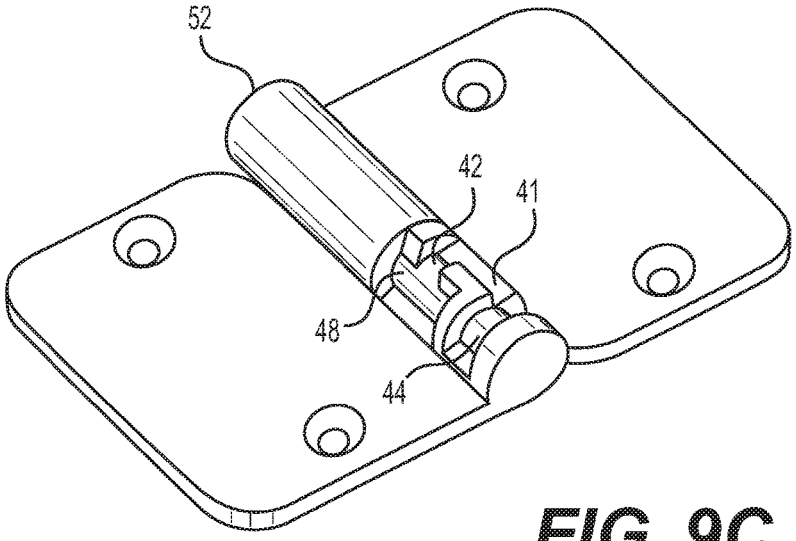
FIG. 9C is a top view of said fastener in the locked and flat position. The four steps of unlocking and taking apart said fastener are illustrated in FIGS. 9D, 9E, 9F and 9G.

FIG. 9C is a top view of the improved take-apart fastener in the locked position revealing that a large portion of the pin 48 is in the barrel 52. The first leg 41 of the keyway and the second leg 42 of the keyway are also illustrated. When the key 51 is engaged with the key groove 44 and the pin 48 is engaged with the barrel 52, the first hinge member 45 and the second hinge member 49 can be rotated simultaneously including any articles mounted to the first hinge member and/or the second member. The first hinge member 45 and the second hinge member 49 can also be rotated independently including any articles mounted to the first hinge member and/or the second hinge member. The key groove 44 extends mostly around the circumference of the pin 48.

Figure 9E:
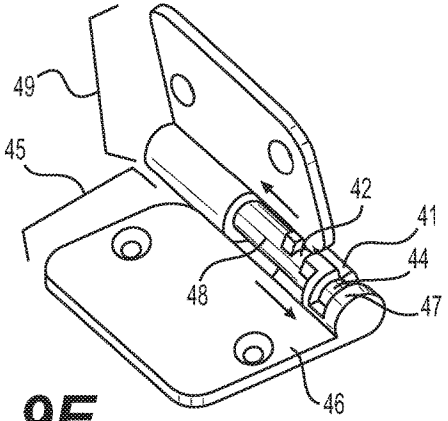
FIG. 9H is a top view of a second example of an improved take-apart fastener comprising a more complex keyway than that of FIG. 9A.
FIG. 9I is a top view of a third example of an improved take-apart fastener comprising a more complex keyway than that of FIG. 9H.
Figure 9G:
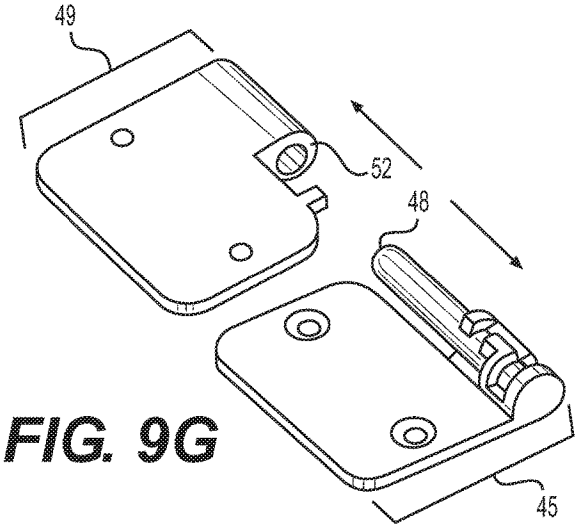
Figure 9D:
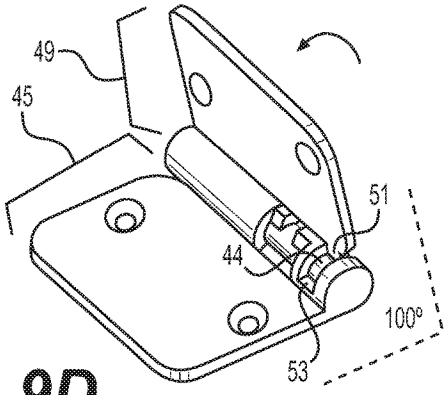
Figure 9F:
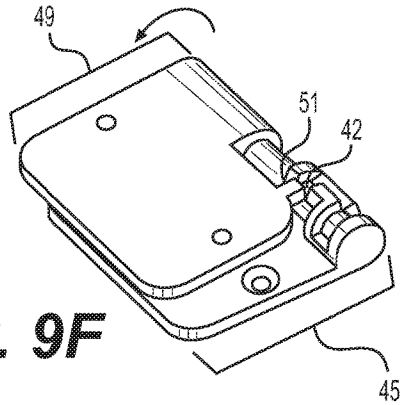

Unlocking and taking apart the instant improved take-apart fastener, with or without mounted articles such as torso segments of a neckwear, requires the user to complete four simple steps as illustrated by the arrows in FIGS. 9D-9G. The first step, as illustrated in FIG. 9D, rotate (close from flat position of 180° in FIG. 9C) the first hinge member 45 and/or second hinge member 49 until the key 51 on the second hinge member is at the entry point of the first leg 41 of the keyway thereby positioning the key 51 within the key groove 44 at the appropriate angle (e.g., approximately 100°) to depart the key groove 44 and enter the first leg 41 of the keyway. (If the hinge member(s) are rotated too much from their flat position of 180° and the key 51 passes the entry point of the first leg 41 of the keyway, the improved take-apart fastener will remain locked since the key groove 44, including a terminal end 53 of the key groove, will not allow the key 51 to exit the key groove 44 unless the key 51 enters the first leg 41 of the keyway. Accordingly, the hinge member(s) are simply rotated back to the appropriate angle, which in this example is approximately 100°). The second step, as illustrated in FIG. 9E, slide the first hinge member 45 and/or second hinge member 49 partially apart, as indicated by the arrows, until the key 51 makes contact with the intersection of the first leg 41 of the keyway and the second leg 42 of the keyway, which prevents the first and second hinge members from further separation. In this example, the first leg 41 of the keyway extends along a longitudinal axis of the pin 48 and the second leg 42 of the keyway extends circumferentially with respect to the pin such that the intersection of the first and second legs of the keyway can be considered perpendicular along the pin. The third step, as illustrated in FIG. 9F, rotate the first hinge member 45 and/or second hinge member 49 further to the appropriate angle (e.g., at least to approximately 160°) so that the key 51 passes through the second leg 42 of the keyway at which point the key is no longer constrained within the second leg of the keyway, which in this embodiment is the last leg of the keyway. Fourth, as illustrated in FIG. 9G, completely slide apart the first hinge member 45 and second hinge member 49, as indicated by the arrows, in which case the pin 48 has been removed from the barrel 52.

These two additional unlocking steps included in FIGS. 9D-9G, as compared to the unlocking steps illustrated in FIGS. 8E and 8F, transform the common take-apart hinge into a quasi-combination lock. Once unlocked and taken apart, putting together and locking the instant improved take-apart fastener simply entails the user performing the said four steps in reverse order. The locked improved take-apart fastener allows any mounted articles, such as the torso segments, to pivot while the pin 48 rotates in the barrel 52 and while the key 51 is engaged with the key groove 44.

The improved take-apart fastener has only two parts consisting of a first hinge member (male end) and a second hinge member (female end), is very strong when locked capable of handling high force and weight loads, does not comprise of any spring, coil, screw, bolt, clasp or the like to function (all of which generally deteriorate over time and eventually may break), has a low profile, and the bottom of said fastener is flat and straight. These features combined with the security feature of the keyway make the improved take-apart fastener an attractive fastening option for various applications including connecting jewelry articles together and connecting the neckband module and torso segments of a neckwear. The improved take-apart fastener, as compared to the prior-art take-apart hinge, greatly reduces the risk of the neckwear disconnecting unintentionally, for example, by random movement or by impact. Moreover, the improved take-apart fastener renders the neckwear more secure against acts of attempted theft while the neckwear in being worn, including attempts to forcibly remove neckwear panel components, as compared to, for example, link-type chains or other inadequate, unsecure fasteners typically used in jewelry.

Accordingly, the improved take-apart fastener provides an example of a fastener that may be mounted to the neckwear panel of a neckwear permitting connectivity across the neckwear panel and allowing all of the mounted torso segments to pivot and be intra-changed. In one exemplary embodiment shown in FIGS. 2A and 2B, the first hinge member (male end) and the second hinge member (female end) of the improved take-apart fastener are mounted to the rear of a metallic neckwear panel for a neckwear having, for example, nine torso segments 16 in the following fashion: the female end 18 of the improved take-apart fastener (key pointing downward) to the bottom portion of the neckband module 15, the male end 17 of the improved take-apart fastener (knuckle facing upward) to the top portion of torso segment one (torso segment directly below the neckband module), the female end 18 of the improved take-apart fastener (key pointing downward) to the bottom portion of torso segment one, the male end 17 of the improved take-apart fastener (knuckle facing upward) to the top portion of torso segment two, the female end 18 of the improved take-apart fastener (key pointing downward) to the bottom portion of torso segment two, the male end 17 of the improved take-apart fastener (knuckle facing upward) to the top portion of torso segment three, the female end 18 of the improved take-apart fastener (key pointing downward) to the bottom portion of torso segment three, the male end 17 of the improved take-apart fastener (knuckle facing upward) to the top portion of torso segment four, the female end 18 of the improved take-apart fastener (key pointing downward) to the bottom portion of torso segment four, the male end 17 of the improved take-apart fastener (knuckle facing upward) to the top portion of torso segment five, the female end 18 of the improved take-apart fastener (key pointing downward) to the bottom portion of torso segment five, the male end 17 of the improved take-apart fastener (knuckle facing upward) to the top portion of torso segment six, the female end 18 of the improved take-apart fastener (key pointing downward) to the bottom portion of torso segment six, the male end 17 of the improved take-apart fastener (knuckle facing upward) to the top portion of torso segment seven, the female end 18 of the improved take-apart fastener (key pointing downward) to the bottom portion of torso segment seven, the male end 17 of the improved take-apart fastener (knuckle facing upward) to the top portion of torso segment eight, the female end 18 of the improved take-apart fastener (key pointing downward) to the bottom portion of torso segment eight, the male end 17 of the improved take-apart fastener (knuckle facing upward) to the top portion of torso segment nine, and the female end 18 of the improved take-apart fastener (key pointing downward) to the bottom portion of torso segment nine. The improved take-apart fasteners described above and shown in FIGS. 2A and 2B are known as a left-handed or left-hand oriented hinges. The improved take-apart fastener may also be as a right-handed or right-hand oriented hinge, which may also be utilized for the instant neckwear and other articles. The method of mounting fasteners to a neckband module or torso segment depends on the type and composition of the fastener utilized for the neckwear panel and the composition of the neckband module and torso segments. The male end and the female end of the improved take-apart fastener may be mounted by any of the various methods known in the art, including brazing or welding, depending on the type and composition of fastener utilized and the composition of the neckband module, torso segment, or any other article as the case may be.

Generally, brazing is a process where similar or dissimilar metals are joined using an alloy that typically includes a base of silver combined with nickel, copper, and zinc, whereas, welding is a process whereby similar metals are joined using a direct heat source to melt the base metal and filler metal to create a uniform finished product. Most welding involves iron-based metals such as steel and stainless steel, but welding is used in other metals such as aluminum. Indeed, fasteners, including improved take-apart fasteners and improved quick-release buckles disclosed herein, may be mounted to any article including the neckband module and torso segments by methods well known in the art other than brazing or welding such as, for example, utilizing screws or bolts. Portions of a fastener may also be provided by being formed as part of a single piece along with the neckband module or torso segments by casting or pressing.

The keyway of an improved take-apart fastener comprises one or more legs along the pin and includes any pattern along the pin including straight line(s), a portion of an arc, and/or a portion of an ellipse. Legs of the keyway may extend along a longitudinal axis of the pin or circumferentially with respect to the pin. The determination of the complexity of a keyway, including the number of legs and type of leg (e.g., linear legs or curved legs), to incorporate on the improved take-apart fastener is a tradeoff between security and ease of taking apart to unlock or putting together to lock the improved take-apart fastener. The more complex the keyway, the greater level of security; the less complex the keyway, the lower level of security and the easier and faster the improved take-apart fastener is to unlock or lock. It will be appreciated that the key of the improved take-apart fastener may be any shape or size to engage the keyway and key groove, including shapes resembling a cuboid or cylinder. The key 51 shown in FIGS. 9B-9G approximates a rectangular prism apart from the one face of the key attached to the second leaf 50, as shown in FIG. 9B. Of course, whatever shape and size of the key, the dimensions of the keyway and key grove are coordinated and fitted with those of the key for appropriate engagement.

Figure 9H:
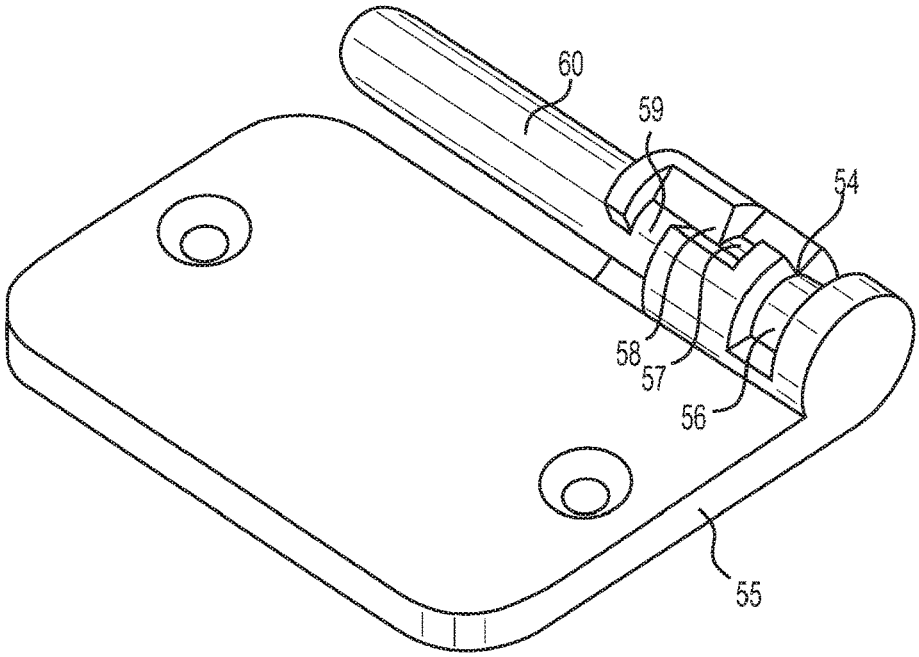

An exemplary embodiment of a more complex keyway with four legs is shown in FIG. 9H. This keyway requires two additional steps, six in total, to unlock or lock the improved take-apart fastener, as compared to the keyway described above and shown in FIG. 9A. The first step is rotate (close from flat position) the first hinge member and/or second hinge member until the key on the second hinge member (not shown) is at the entry point of the first leg 54 of the keyway on the first hinge member 55 thereby positioning the key on the second hinge member at the appropriate angle to depart the key groove 56 and enter the keyway. The second step is slide the first hinge member and/or second hinge member partially apart until the key makes contact with the intersection of the first leg 54 of the keyway and second leg 57 of the keyway which stops the first and second hinge members from further separation. The third step is rotate the first hinge member and/or second member further to the appropriate angle until the key is at the entry point of the third leg 58 of the keyway. The fourth step is slide the first hinge member and/or second hinge member partially apart further until the key makes contact with the intersection of the third leg 58 of the keyway and fourth leg 59 of the keyway which stops the first and second hinge members from further separation. The fifth step is rotate the first hinge member and/or second hinge member even further to the appropriate angle so that the key passes through the fourth leg 59 of the keyway at which point the key is no longer constrained within the keyway. The sixth step is completely slide apart the first and second hinge members in which case the key has passed the pin 60 and the pin has been removed from barrel.

Figure 9I:
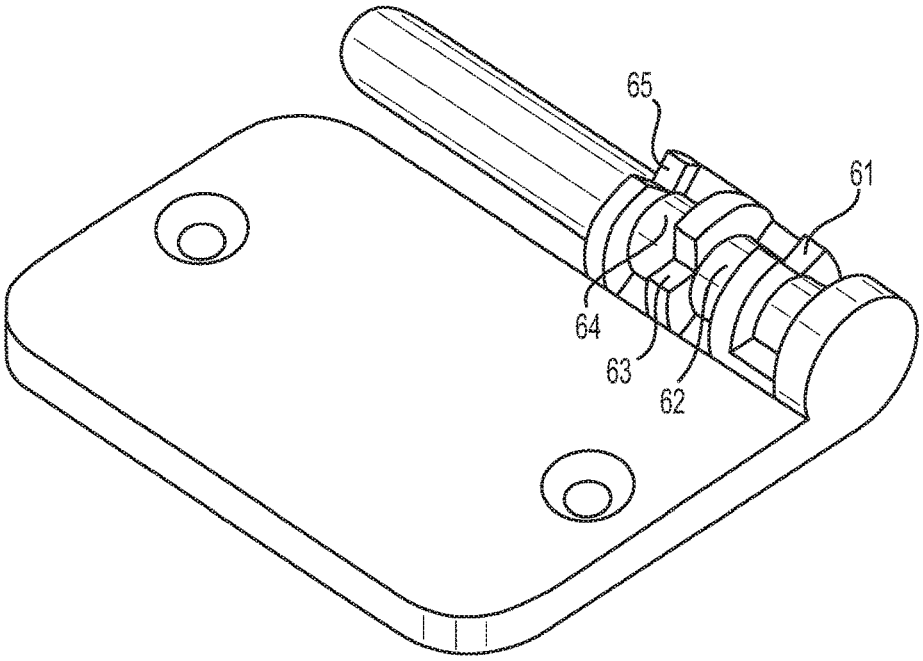

An exemplary embodiment of an even more complex keyway of an improved take-apart fastener is shown in FIG. 9I. This keyway comprises five legs, a first leg 61, a second leg 62, a third leg 63, a fourth leg 64 and a fifth leg 65. This keyway requires six steps to unlock or lock the improved take-apart fastener. The fifth step requires the user to rotate the first hinge member and/or second hinge member in the opposite direction, as compared to step three, the difference is that step five entails closing the hinge member(s) (from the flat position) not opening the hinge member(s) (from the flat position) as in step three. An additional security measure of this keyway, as compared to the keyway of FIG. 9H, is that for the portions of the keyway which extend circumferentially with respect to the pin, the key is free to engage these portions of the keyway in both circumferential directions upon the key making contact with an intersection of two legs. This feature makes an unauthorized user, who does not know the keyway pattern of a locked improved take-apart fastener, to guess as to which way to rotate the hinge member(s) when attempting to unlock the hinge.

In addition to the incorporation of the keyway for additional security, there are other improvements of the improved take-apart fastener shown in FIGS. 2A, 2B and 9A-9I, as compared to the prior-art take-apart hinge described above and shown in FIGS. 8A-8F. These improvements for some embodiments such as neckwear embodiments include that the knuckle 47 of the improved take-apart fastener is flush with the first leaf 46 (does not overlap first leaf as in FIGS. 8A-8F) and the barrel 52 of the improved take-apart fastener does not protrude as much past the second leaf 50 on the barrel end. Also, the size of the first leaf and the second leaf have been reduced in the embodiment in FIGS. 2A and 2B. These additional improvements result in the improved take-apart fastener being more streamlined. It will be appreciated that the size of the first hinge member and second hinge member, including the diameter of pin and/or barrel, may vary depending on the specific application.

The first leaf and/or second leaf of an improved take-apart fastener may include any number of holes in any position for mounting an article. As shown in FIGS. 9B-9I, every first leaf and second leaf has two holes for mounting an article. Improved take-apart fasteners may be bolted, for example, to any article including the torso segments and neckband module of a neckwear. In other embodiments, a first leaf and/or a second leaf may not include holes for mounting. For example, as in FIGS. 2A and 2B, improved take-apart fasteners may be mounted by being brazed to the torso segments and neckband module.

Improved Quick-Release Buckles

In another aspect, the present inventor devised new and improved quick-release buckles that can be used with a variety of articles. The inventor identified a need for better connecting objects with quick-release buckles, including the need for a quick-release buckle to have the capability to be mounted, for instance brazed, to one or more objects and the need for a quick-release buckle to provide pivoting capability to one or more objects mounted to the quick-release buckle(s). In some exemplary embodiments, improved quick-release buckle(s) allow the mounted objects to be intra-changeable or interchangeable.

In some exemplary embodiments, improved quick-release buckles are used with the instant neckwear herein for connecting components of a neckwear panel and providing pivoting capability to the torso segments along with features of intra-changeability and interchangeability. In other exemplary embodiments, improved quick-release buckles are mounted to objects requiring pivoting capability and capability to be quickly and easily intra-changed or interchanged. Any fashion accessory equipped with improved quick-release buckles such as interchangeable watchbands or interchangeable purse chains or handles offers greater utility including versatility to the user since many combinations may be achieved by interchanging only a portion of the article but resulting in drastically altered appearances of the article. For example, a luxury wristwatch with a silver watchband (capable of being interchanged with other watchbands) will take on a completely new look upon an interchangeable gold watchband temporarily or permanently replacing the silver watchband. Wristwatches and watchbands equipped and configured with improved quick-release buckles provide increased utility of the wristwatch to the user since either the case of the wristwatch or the watchband can instantly be switched by the user for whatever reason, or replaced if either the case of the wristwatch or the watchband is damaged, with interchangeable cases and interchangeable watchbands without any key, tool or the like or without having to visit a jeweler.

In other exemplary embodiments, improved quick-release buckles are mounted to objects that may not require pivoting capability but require a secure fastener and features of intra-changeability and/or interchangeability. Examples include jewelry articles or portions of jewelry articles which may be connected with improved quick-release buckles. Due to the inherent strength of quick-release buckles, which in part is a result of the engagement action of the spring-fit arms into the release openings of the receiving chamber as further described below, improved quick-release buckles are an improvement over typical clasps or the like used on necklaces and bracelets. Indeed, improved quick-release buckles are suitable for any application of any object requiring the aforementioned attributes.

Quick-release buckles are well known in the art and are useful to connect and disconnect belts and to unjoin and join webbing straps. They have impressive force and weight load capacities and do not require any tools or the like to engage or disengage. U.S. Pat. No. 6,226,844 B1 to Lerra et al. discloses side release buckles that include a first buckle component having an engagement end and a module receiving portion opposite the engagement end; and a second buckle component having an engagement end constructed for releasable engagement with the engagement end of the first buckle component, and a module receiving portion opposite the engagement end.

Figure 10A:
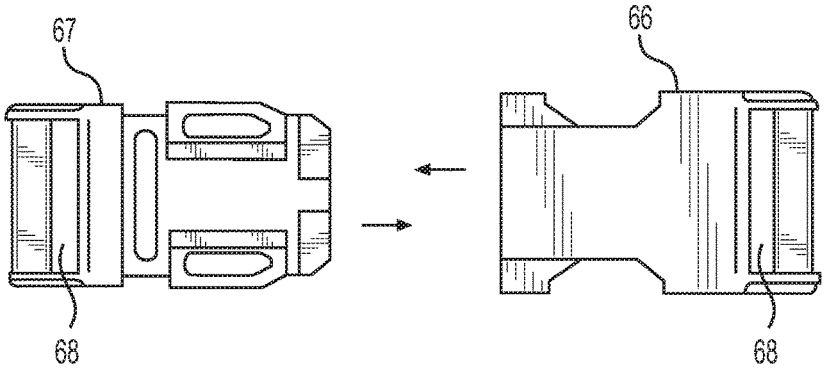
FIG. 10A (PRIOR ART)
FIG. 10A is a top view of a prior-art belt buckle in the disengaged position, which is FIG. 2 in U.S. Pat. No. 6,792,654 B2 to Schmitz.
Figure 10B:
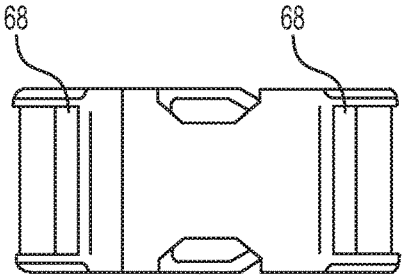
FIG. 10B (PRIOR ART)
FIG. 10B is a top view of said buckle in the engaged position, which is FIG. 3 in said patent.
Figure 10C:
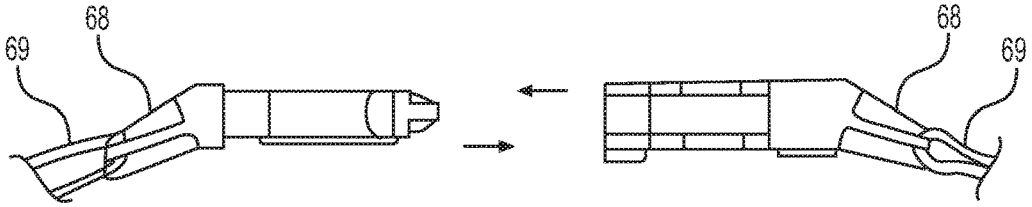
FIG. 10C (PRIOR ART)
FIG. 10C is a side view of said buckle in the disengaged position, which is FIG. 1 in said patent.

U.S. Pat. No. 6,792,654 B2 to Schmitz (published international application WO 01/82737) discloses a metal belt buckle comprising two buckle members, fastened on belt ends, the first of said members having a receiving compartment in which the second buckle member is axially inserted and said second buckle member comprises snap-fit members that are adjusted against a spring force and that interact with undercuts in the first buckle member to secure the fitted buckle members. FIG. 10A (FIG. 2 in 654 patent) is a top view of the belt buckle to Schmitz in which the first buckle member 66 including eye loop 68 and the second buckle member 67 including eye loop 68 are in the disengaged position. A top view of the belt buckle in the engaged position is shown in FIG. 10B (FIG. 3 in 654 patent) demonstrating that the two eye loops 68 at the end of both buckle members, including the bars forming and surrounding the two eye loops, cumulatively comprise a large portion of the entire length of the belt buckle. A side view of the belt buckle in the disengaged position is shown in FIG. 10C (FIG. 1 in 654 patent) revealing that belt ends 69 are secured to the eye loops 68 of the first and second buckle members, and the eye loops are angled downward creating a hindrance for mounting or connecting articles for applications requiring a fastener with a low profile and/or with a flat and straight bottom (planar bottom).

Although Lerra's side release buckles and Schmitz's belt buckle are useful to connect and disconnect belts and to unjoin and join webbing straps together for backpacks, luggage, and other types of articles, they are not intended, designed or suited for being mounted (including being brazed or bolted) to objects including the neckband module and torso segments of a neckwear, watches, watchbands and other fashion accessories such as jewelry articles; nor are they suitable for allowing objects to pivot. For example, the side release buckles to Lena et al. and the belt buckle to Schmitz do not have a suitable design and are therefore deficient for mounting to a neckwear panel of the present disclosure; nor do they have any mechanism such as a hinge to allow torso segments or other mounted objects to pivot.

Accordingly, improved quick-release buckles provide an example of a fastener that may be mounted to the neckwear panel of a neckwear permitting connectivity across the neckwear panel and allowing the mounted torso segments to pivot and be intra-changed. In one exemplary embodiment shown in FIGS. 3A and 3B, hinge platforms of the male end and female end are mounted to the rear of a metallic neckband panel for a neckwear having, in this example, nine torso segments 16, including eight intra-changeable torso segments (from torso segment one through torso segment eight), in the following fashion: the male end 22 of the quick-release buckle (lead of center guide facing downward) to the bottom portion of the neckband module 15, the female end 23 of the quick-release buckle (opening of receiving chamber facing upward) to the top portion of torso segment one (torso segment directly below the neckband module), the male end 22 of the quick-release buckle (lead of center guide facing downward) to the bottom portion of torso segment one, the female end 23 of the quick-release buckle (opening of receiving chamber facing upward) to the top portion of torso segment two, the male end 22 of the quick-release buckle (lead of center guide facing downward) to the bottom portion of torso segment two, the female end 23 of the quick-release buckle (opening of receiving chamber facing upward) to the top portion of torso segment three, the male end 22 of the quick-release buckle (lead of center guide facing downward) to the bottom portion of torso segment three, the female end 23 of the quick-release buckle (opening of receiving chamber facing upward) to the top portion of torso segment four, the male end 22 of the quick-release buckle (lead of center guide facing downward) to the bottom portion of torso segment four, the female end 23 of the quick-release buckle (opening of receiving chamber facing upward) to the top portion of torso segment five, the male end 22 of the quick-release buckle (lead of center guide facing downward) to the bottom portion of torso segment five, the female end 23 of the quick-release buckle (opening of receiving chamber facing upward) to the top portion of torso segment six, the male end 22 of the quick-release buckle (lead of center guide facing downward) to the bottom portion of torso segment six, the female end 23 of the quick-release buckle (opening of receiving chamber facing upward) to the top portion of torso segment seven, the male end 22 of the quick-release buckle (lead of center guide facing downward) to the bottom portion of torso segment seven, the female end 23 of the quick-release buckle (opening of receiving chamber facing upward) to the top portion of torso segment eight, the male end 22 of the quick-release buckle (lead of center guide facing downward) to the bottom portion of torso segment eight, and the female end 23 of the quick-release buckle (opening of receiving chamber facing upward) to the top portion of torso segment nine. The hinge platforms, hinge towers or hinges of the first buckle member (male end) and second buckle member (female end) of the improved quick-release buckle may be mounted by any of the various methods known in the art, including brazing or welding, depending the type and composition of the buckle members, hinge platforms, hinge towers and/or hinges utilized and the composition of the neckband module, torso segment, or any other article as the case may be.

Figure 11A:
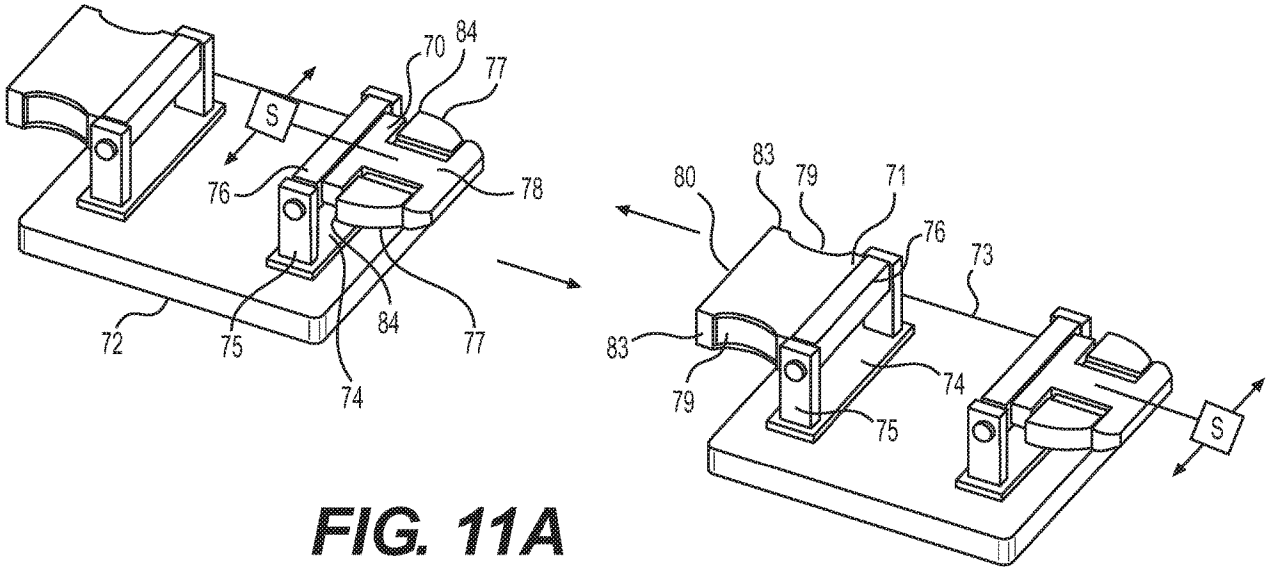
FIG. 11A is a top view of an exemplary embodiment of improved quick-release buckles in the disengaged position and mounted to two unconnected torso segments.
Figure 11B:
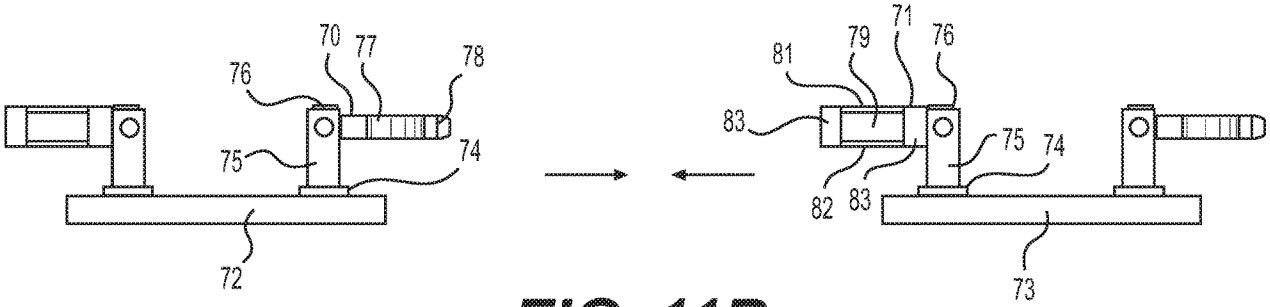
FIG. 11B is a side view of said exemplary embodiment of said buckles in the disengaged position and mounted to two unconnected torso segments.

FIG. 11A is a top view and FIG. 11B is a side view of an exemplary embodiment of the improved quick-release buckle (in cast metal) which includes a first buckle member (male end) 70 and a second buckle member (female end) 71. The male end 70 includes two spring-fit arms 77, a spring (represented by a spring symbol "S" in FIG. 11A with arrows showing directionality of the force of the spring) and center guide 78, and the female end 71 includes one release opening 79 on each side of the receiving chamber 80. As illustrated by the arrows, the front of the center guide 78 is the engagement end of the male end and the receiving chamber 80 is the engagement end of the female end. The receiving chamber 80 is a hollow cavity within the female end 71, is open at the front of the female end, and is delimited by an upper wall portion 81, a lower wall portion 82, and a side wall portion 83 on each side of both release openings 79. The upper and lower wall portions, above and below each release opening 79 on each side of the female end 71, are clipped and curved inward for engagement of the spring-fit arms 77. The dimensions of the male end 70 are coordinated with the female end 71 in such a way that the male end can be inserted or pushed into the receiving chamber 80 of the female end. Accordingly, the male end 70 includes a center guide 78 to which are articulated or coupled two latching or spring-fit arms 77 in such a way that when the male end is inserted into the receiving chamber, the spring-fit arms pivot inwardly. Once the two spring-fit arms 77 have passed the side wall portions (in front of the release openings) 83 and have fully entered the two release opening 79, the two spring-fit arms move and pivot outwardly by a compression spring (represented by a spring symbol "S" with arrows showing directionality of the force of the spring) that acts upon them, so that each rear facing corner 84 of each spring-fit arm 77 comes to rest and catches behind each side wall portion (in front of the release openings) 83, thereby locking the improved quick-release buckle. Therefore, locking the improved quick-release buckle is extraordinarily simple and takes approximately one second by either inserting the male end 70 into the female end 71 or simply pushing the female end past the two spring-fit arms 77 of the male end. Any type of suitable spring or spring-like mechanism may be employed within the male end to allow the spring-fit arms to move and pivot.

As shown in FIG. 11A, a hinge platform 74, a hinge tower 75 and a hinge 76 are mounted on the first buckle member (male end) 70 opposite the engagement end and are mounted on the second buckle member (female end) 71 opposite the engagement end. Substantially identical hinges 76 are in lieu of the eye loops for the securement of belt ends of the belt buckle of the 654 Patent (similar to the web-receiving slots to join webbing straps or the like of the quick release buckles in the 844 Patent) and the bars forming and surrounding said eye loops (and likewise said web-receiving slots). The hinges 76 are positioned approximately at the location of said eye loops/web-receiving slots. Substantially identical hinge towers 75 support the hinges 76 and the hinge towers are mounted to the hinge platforms 74 which are mounted to the rear of each of two torso segments 72, 73. Said eye loops and web-receiving slots for receiving belt straps, webbing straps or the like are not only rendered useless for certain applications of the improved quick-release buckle, including being mounted to and connecting a neckband module and torso segments of the instant neckwear herein, but would impede the functionality of certain applications of the improved quick-release buckle. The male end 70 including the hinge 76 and the female end 71 including the hinge 76 may be disposed at any distance above the hinge platforms 74, and by extension, any articles mounted to the hinge platforms, which in this example are the two torso segments 72, 73. Although hinge platforms 74 provide greater strength and security, the hinge towers 75 or the hinges 76 may be directly mounted to the torso segments 72, 73 or other articles as the case may be. Any suitable type or size of hinge may be utilized.

Figure 11C:
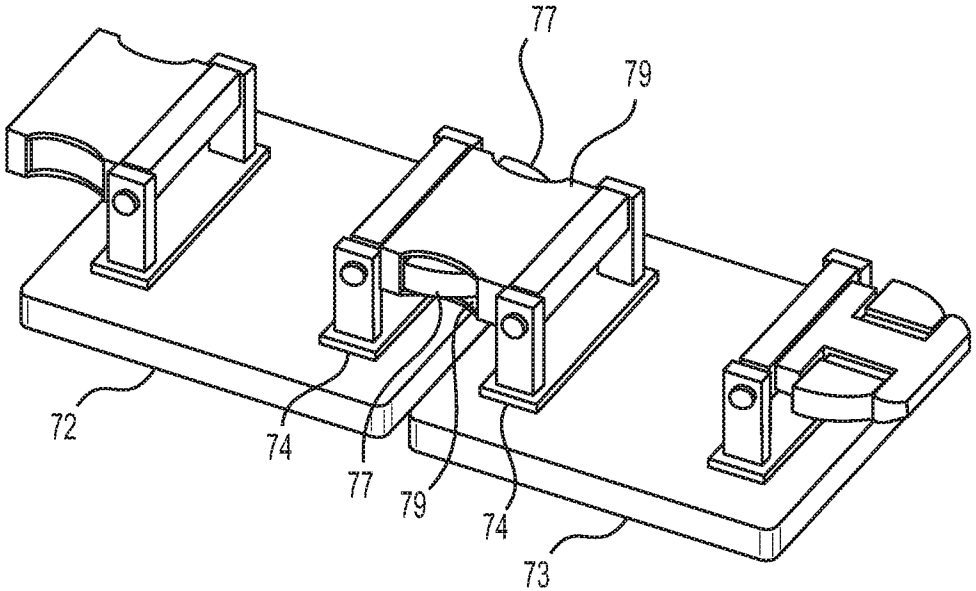
FIG. 11C is a top view of said exemplary embodiment of said buckles in the engaged position mounted to two connected torso segments.

As shown in FIG. 11C, two spring-fit arms 77 have entered, and are fully expanded into, the release openings 79 locking the first and second buckle members of the improved quick-release buckle. Once the spring-fit arms are fully expanded into the release openings, they snap and lock. The fact that the user hears a clicking sound upon the buckle members being locked is an advantageous feature of the improved quick-release buckle for all embodiments disclosed herein since this "click" provides assurance that the buckle is indeed locked. This interlocking action is what affords side-release buckles their tremendous strength relative to their size and makes improved quick-release buckles an ideal solution for a number of fastening applications. Moreover, unlike center-release buckles which have a single pressure point or trigger mechanism to disengage and unlock the center release buckle, the improved quick release buckle has two pressure points to disengage and unlock the buckle, thereby reducing the risk of the buckle disconnecting inadvertently by random movement or impact. To unlock the improved quick-release buckle, the user simply presses the spring-fit arms 77 simultaneously while sliding apart the male end and/or the female end to disengage them from both release openings 79.

Figure 12A:
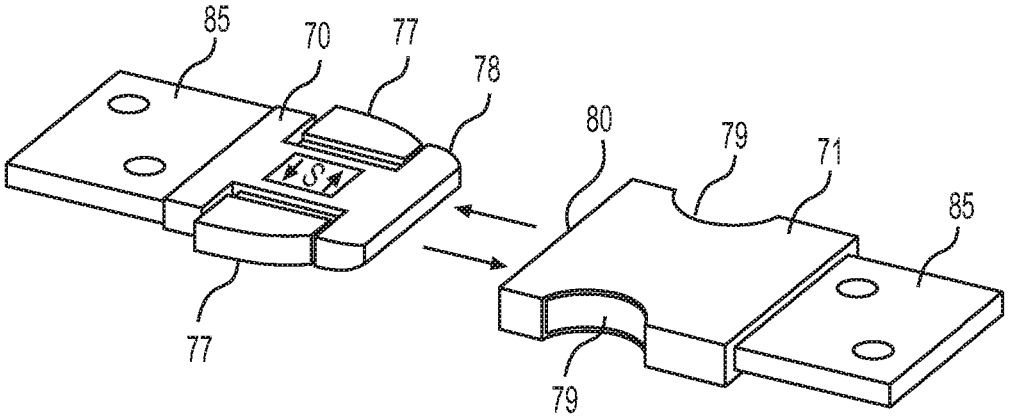
FIG. 12A is a top view of an exemplary embodiment of an improved quick-release buckle with a mounting shaft appended to the first buckle member (male end) and second buckle member (female end).

Improved quick-release buckles can be used with a variety of objects or portions of objects requiring connectivity, pivoting motion, intra-changeability and/or interchangeability. As shown in FIG. 12A, in place of hinge platforms and for objects that may not require pivoting motion but require connectivity, intra-changeability and/or interchangeability, a mounting shaft 85 is mounted to the first buckle member (male end) 70 opposite the engagement end and to the second buckle member (female end) 71 opposite the engagement end to assist in mounting the buckle member(s) to certain objects. In the exemplary embodiment in FIG. 12A, the male end includes two spring-fit arms 77, a spring (represented by a spring symbol "S" with arrows showing directionality of the force of the spring) and center guide 78, and the female end 71 includes one release opening 79 on each side of the receiving chamber 80, as described in further detail in the above disclosure of the embodiment of the improved quick-release buckle in FIGS. 11A-11C. A necklace comprising of multiple segments, for example, can be configured with a male end and/or a female end of an improved quick-release buckle, which may include a mounting shaft at the terminal ends of the segment(s). Advantages include that each segment may be intra-changed or interchanged and therefore multiple lengths may be achieved by adding or removing segments. A mounting shaft may be any size or shape and may be incorporated on the male end and/or female end of an improved quick-release buckle at any position to accommodate a specific application. A neckband module and/or torso segment(s) of a neckwear may be configured with at least one male end and/or at least one female end of an improved quick-release buckle which may include a mounting shaft. Although the pivoting capability of a neckwear panel including said torso segments may be limited, not all torso segments of a neckwear panel may include said torso segments. Exemplary alternative embodiments to incorporating a mounting shaft for mounting an object to the improved quick-release buckle include portions of the male end and/or the female end may be encased within an object or the male end and/or female end may be elongated or the shape of the male end and/or the female end is otherwise modified to achieve satisfactory mounting.

Figure 12B:
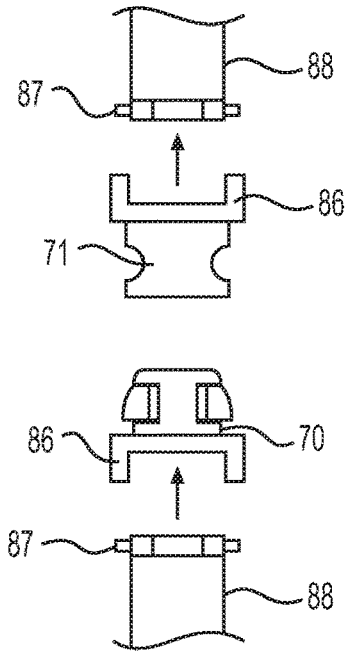
FIG. 12B is a top view of an exemplary embodiment of an improved quick-release buckle including a pin receptacle and a pin connecting two jewelry segments.
Figure 12C:
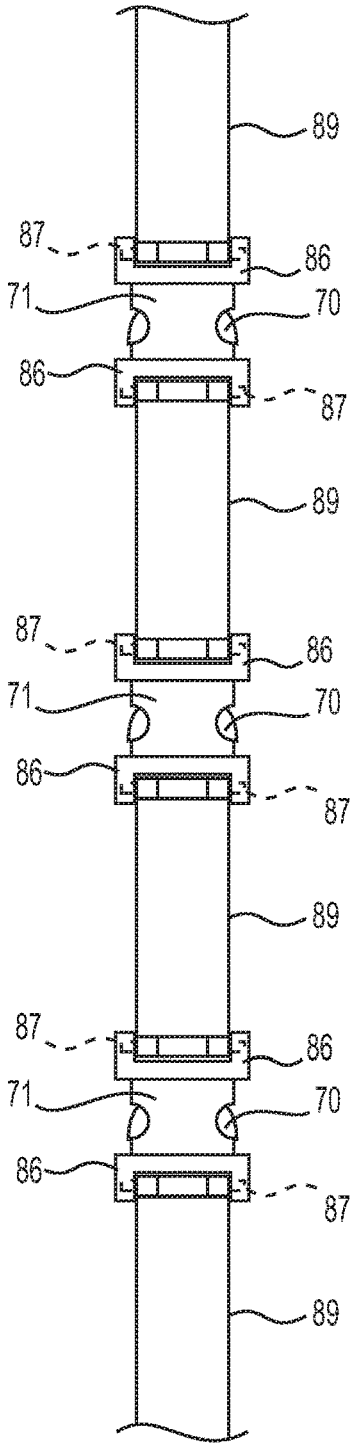
FIG. 12C is a top view of an exemplary embodiment of improved quick-release buckles including pin receptacles and pins connecting four segments of a jewelry article.

Similar to the exemplary embodiment of FIGS. 11A-11C, but without hinge platforms or hinge towers, at least one of the two buckle members of an improved quick-release buckle may include a pin and/or be configured to receive a pin of an object, in either case, for the improved quick-release buckle to provide pivoting motion, connectivity, intra-changeability and/or interchangeability to an object. For example, as shown in the exemplary embodiment of FIG. 12B, a male end 70 and a female end 71 of an improved quick-release buckle include, and are configured with, a pin receptacle 86. Each pin receptacle is configured with a pin 87 and the pin has been employed on both terminal ends of a jewelry article 88 to engage the openings within each pin receptacle 86. Any suitable type of pin may be utilized. The advantages of the improved quick-release buckle as a fastener over typical jewelry fasteners such as clasps include increased strength and security and a more straightforward fastener to easily connect and lock or disconnect and unlock jewelry articles. In the exemplary embodiment of FIG. 12C, four segments 89 of a jewelry article are connected with three male ends 70 and three female ends 71 of improved quick-release buckles which are all engaged in the locked position. The six terminal ends shown of the four jewelry segments 89 shown include a pin 87 and the three male ends 70 and the three female ends 71 of the improved quick-release buckles include a pin receptacle 86. The pins and pin receptacles are configured for one other and the six pins 87 are engaged with the six pin receptacles 86. Any suitable type of pin may be utilized. Segments of any object connected in this fashion allow pivoting motion, intra-changeability and interchangeability including these jewelry segments, which may be intra-changed with each other or interchanged with jewelry segments that the jewelry article was not comprised of originally. A neckband module and/or torso segment(s) of a neckwear may be configured with at least one male end and/or at least one female end of an improved quick-release buckle including a pin and pin receptacle. For example, the bottom portion of a neckband module may include a mounted female end including a pin receptacle and a pin, the top portion of torso segment one may include a mounted male end including a pin receptacle and a pin, the bottom portion of torso segment one may include a mounted female end including a pin receptacle, and the top portion of torso segment two may include a mounted male end including a pin receptacle and a pin a pin, et cetera, depending how many torso segments a neckwear comprises. Indeed, for other objects including purse handles or purse chains, improved quick-release buckles with pins and pin receptacles are an attractive solution. In an exemplary embodiment of purse handles or purse chains, a purse may include two female ends of an improved quick-release buckle and the two terminal ends of the purse handle or purse chain may include two male ends of an improved quick-release buckle with pins and pin receptacles. For certain applications requiring additional security without the risk of pins being compromised or breaking, including for a neckwear, a mounting housing, as further described below and shown in FIGS. 12D and 12E, may be utilized in place of pin receptacles and pins. In the exemplary embodiments of FIGS. 12B and 12C, the male end includes two spring-fit arms, a spring and center guide, and the female end includes one release opening on each side of the receiving chamber, as described in further detail in the above disclosure of the embodiment of the improved quick-release buckle in FIGS. 11A-11C.

In another exemplary embodiment of the improved quick-release buckle, wristwatches and watchbands configured for, and including improved quick-release buckles, provide advantages over wristwatches and watchbands in the art. Various types of watchbands including watch bracelets exist to secure a wristwatch to a wrist. In addition to typical leather straps with a buckle, metal watch bracelets that often come with luxury wristwatches include clasps or buckles known as, double opening deployment clasps, three-blade deployment buckles, butterfly clasps and double safety clasps. One of the major considerations in the design of these clasps and buckles is a high level of security to prevent the wristwatch from inadvertently falling off the wrist or being grabbed and stolen off the wrist. Generally, the more valuable the timepiece, the sturdier its watchband including buckles or clasps of the watchband. Clasps or buckles of secure watchbands tend to be cumbersome to engage (lock) or disengage (unlock) since strength and security are paramount concerns. For example, the "steel double safety clasp" that is standard on the Men's Swiss Formula 1® wristwatch (41 mm, two-tone stainless steel bracelet, manufacturer reference: WAZ1120.BB0879), manufactured and sold by Tag Heuer®, has six moving parts which do not include any of the pins or hinges connecting these six moving parts. Engaging or disengaging this steel double safety clasp requires more than one distinct operation. Further, the engaging process requires multiple parts of the steel double safety clasp to pivot in specific directions which sometimes forces the wearer to start the engaging process all over again if at least one of these multiple parts pivots in the wrong direction during an engagement attempt.

Metal bracelets, predominately those of valuable wristwatches and including those made from precious metals, have other drawbacks including that they cannot be quickly and easily switched or replaced with interchangeable watchbands without any tools or the like or without having to visit a jeweler. Due to the complexity of certain clasps and buckles, up to approximately 25 percent of the surface area of watch bracelets may consist of the clasp or buckle which reduces the aesthetics of the wristwatch by interrupting the continuous construction of the bracelet. Although interchangeable watchbands are known in the art, a major drawback is that their fasteners connecting and disconnecting the wristwatch case to and from the watchband are comprised of pins or tabs which lack a high level of strength and security and are easily disengaged. Another drawback of said interchangeable watchbands is that their pins or tabs require precise alignment when attempting to engage small pins or tabs with small pin holes or tab holes which is tedious and not accomplished quickly in approximately one second.

Figure 12D:
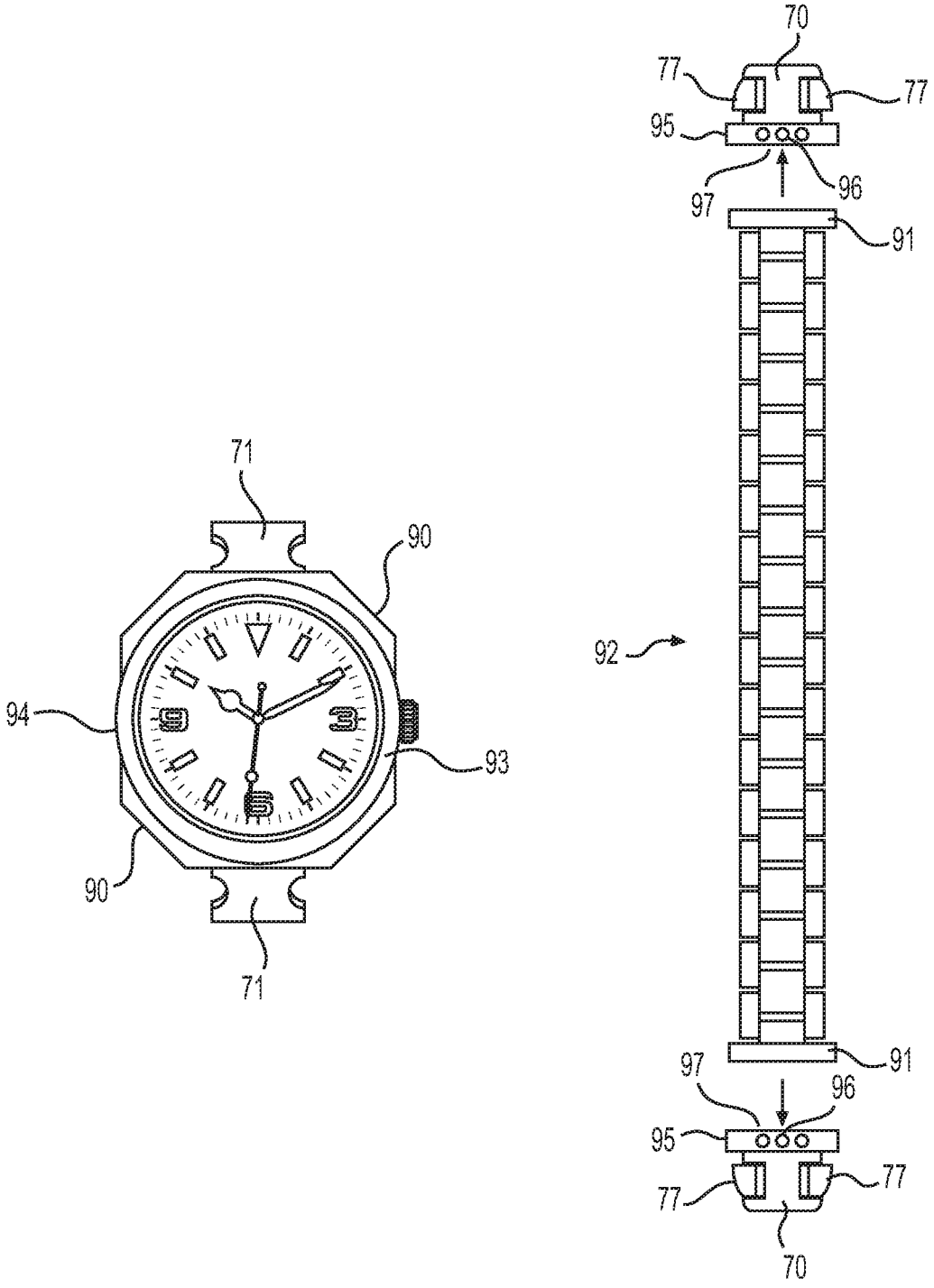
FIG. 12D is a top view of an exemplary embodiment of an interchangeable wristwatch and interchangeable watchband, both configured with improved quick-release buckle members.

Accordingly, as shown in the embodiment of FIG. 12D, an exemplary wristwatch configuration with improved quick-release buckles includes two female ends 71, each female end partially encased and mounted within upper and lower lug frames 90 and one male end 70 of the improved quick-release buckle for each mounting member 91 of the watchband 92, which may also include holes for mounting. The two partially encased female ends 71 are angled downward (away from bezel 93) and the degree of the angle depends on various factors including type of wristwatch, the diameter and thickness of the case 94 of the wristwatch, type of watchband, and size of the male end and female end buckle members. Each male end includes an incorporated mounting housing 95 which may comprise mounting holes 96 at the top and/or bottom of the mounting housing for secure mounting (e.g., screw or bolt type fastener and/or welded). Each mounting housing 95 has a sufficient opening 97 at its front (facing the watchband) to accept each mounting member 91 of the watchband 92 for mounting (in the direction of each arrow). The other sides of the mounting housing are delimited by a back wall and two side walls.

Wristwatches and watchbands configured for, and including, improved quick-release buckles provide a high level of security due to the inherent strength of the improved quick-release buckles plus the fact that this exemplary embodiment does not include any pins or tabs within the connection between the wristwatch and the watchband. This security feature is most relevant for luxury wristwatches which may include watchbands made of precious metals. The process of either taking a wristwatch off a wrist or putting a wristwatch on a wrist is extraordinary simple with this assembly since only one of the two improved quick-release buckles requires disengagement to take a wristwatch off a wrist or engagement to put a wristwatch on a wrist. The process to unlock the improved quick-release buckle to remove a wristwatch from the wrist, for example, may be accomplished by the wearer with one distinct operation of pressing both spring-fit arms 77 simultaneously on either one of the male ends 70, preferably with the thumb and forefinger, while pulling out the male end from the female end 71 thereby freeing the wristwatch from the wrist. The process to lock the improved quick-release buckle to secure a wristwatch to the wrist, for example, is also accomplished by the wearer with one distinct operation of simply inserting the male end 70 on the watchband (that was previously disengaged when watchband was removed) into the corresponding female end 71 within the corresponding lug frame 90. Moreover, locking or unlocking the improved quick-release buckle takes approximately one second to accomplish since the male and female ends of the improved quick-release buckle are quickly and easily engaged or disengaged with one another without having to tediously align pins or tabs with pin holes or tab holes. In the exemplary embodiment of FIG. 12D, the male end includes two spring-fit arms, a spring, and center guide, and the female end includes one release opening on each side of the receiving chamber, as described in further detail in the above disclosure of the embodiment of the improved quick-release buckle in FIGS. 11A-11C.

Figure 12E:
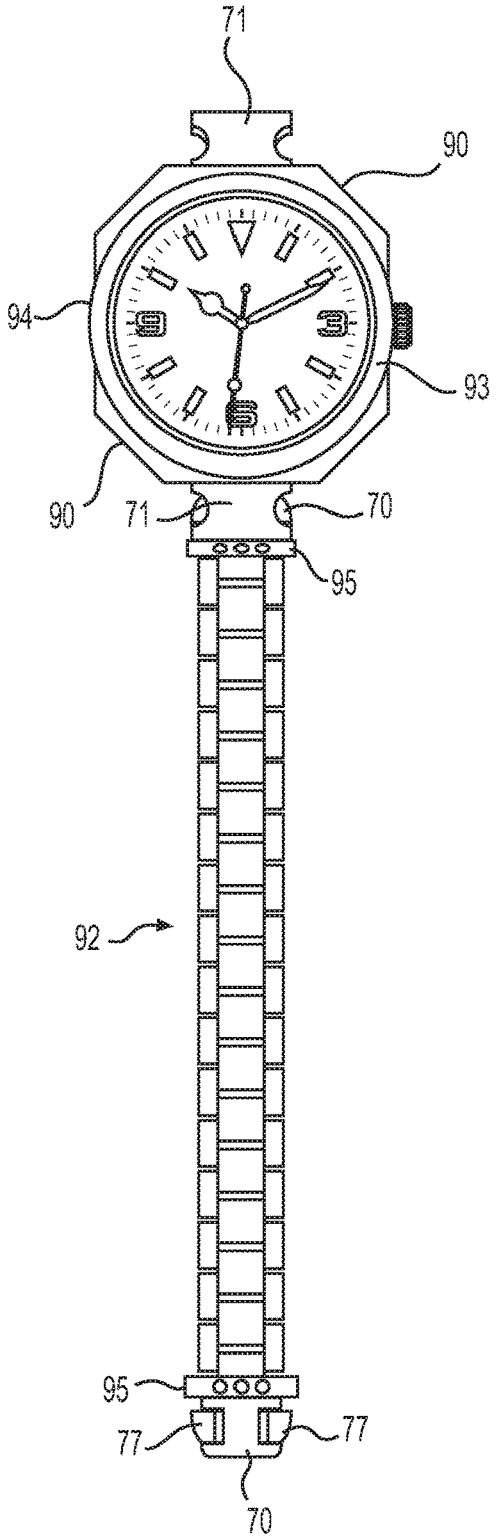
FIG. 12E is a top view of the embodiment of FIG. 12D with one end of the watchband connected to the wristwatch.

Upon the user desiring to switch the wristwatch or switch the watchband of FIGS. 12D and 12E with an interchangeable wristwatch or an interchangeable watchband, both improved quick-release buckles are quickly and easily disengaged within a matter of a few seconds; the female end 71 encased within the top lug frame 90 and the other the female end 71 encased within the bottom lug frame 90 are disengaged from both male ends 70 on the watchband 92. Subsequently, the two male ends of the interchangeable watchband are quickly and easily engaged, also within a matter of a few seconds, with the two female ends 71, one mounted within the top lug frame 90 and one mounted within the bottom lug frame 90. Wristwatches and watchbands that are interchanged as quickly and easily as in the present disclosure are useful in smartwatches, activity trackers, and other wearable technology devices. The computing and wireless capabilities of these wearable technology devices can be augmented or diversified by interchangeable wristwatches and watchbands. Interchangeable watchbands may also have computing capability, including to process or store data or transmit data wirelessly, either in conjunction with, or independent of, the case of the smartwatch, activity tracker, or other wearable technology device.

Once a wristwatch having a metal bracelet with the aforementioned types of clasps or buckles is removed from the wrist, the wristwatch and metal bracelet, which are continuous without breaks, cannot be stretched out from end to end and placed flat on a surface. The wristwatch is often either stacked directly onto its bracelet causing metal-on-metal contact between the case of the wristwatch and the bracelet, or the wristwatch is placed on its side causing risk of wear and tear to the wristwatch case, bezel and crown or risk of the wristwatch flipping over onto the crystal (protective transparent layer over the dial) causing damage. As shown in FIG. 12E, interchangeable wristwatches and watchbands configured for, and including, improved quick-release buckles also allow the wristwatch and watchband connected to the wristwatch, which may be a metal bracelet, to be stretched out from end to end and placed flat on a surface after being removed from the wrist by disengaging one improved quick-release buckle. This configuration prevents the case 94 of the wristwatch to come into contact with the watchband 92, prevents portions of the watchband to come into contact with one another, prevents the sides of the watchband to come in contact with the any surface, and reduces the risk of the wristwatch flipping over onto the crystal thereby preventing unnecessary wear and tear to the case and watchband. Indeed, the case 94 and bezel 93 of the wristwatch need not touch any surfaces since the one female end 71 of the improved quick-release buckle at the top of the wristwatch and the mounting housing 95 at the bottom of the wristwatch come in contact with the surface. Watches and watchbands including improved quick-release buckles result in an attractive and efficient design while benefiting from the inherent strength of quick-release buckles due to their opposable, engagable and releasable buckle components. An improved quick-release buckle has two pressure points or trigger mechanisms (the two spring-fit arms) to disengage the buckle. The result is a high level of security while providing interchangeability features. Indeed, for many other objects including neckwear, necklaces, bracelets, purse handles or purse chains, improved quick-release buckles with mounting housings are an attractive solution. In an exemplary embodiment of purse handles or purse chains, a purse may include two female ends of an improved quick-release buckle and the two terminal ends of the purse handle or purse chain (mounting members) may include two male ends of an improved quick-release buckle with mounting housings.

In a modified embodiment of FIGS. 12D and 12E, the watchband 92 may also include an additional clasp or buckle such as a quick-release buckle which may be located at the approximate middle of the watchband. In another modified embodiment, only one of the two lug frames 90 includes a female end 71 (or alternatively one male end) of the improved quick-release buckle and the watchband 92 only includes one male end 70 (or alternatively one female end) of the improved quick-release buckle. If a wristwatch does not include any lug frames, the case of the wristwatch may include one female end 71 (or alternatively one male end) of the improved quick-release buckle and, of course, the watchband 92 only includes one male end 70 (or alternatively one female end). It will be appreciated that for certain applications, including those for wristwatches and jewelry, improved quick-release buckles are generally relatively smaller as compared to quick-release buckles for other applications. For example, this may include shorter spring-fit arms and release openings which reduces the overall length of the improved quick-release buckle.

While the disclosure herein of improved quick-release buckles has been in the context of side-release buckles, other embodiments include any type of buckle comprising opposable, engagable and releasable buckle components. Examples include center-release buckles, buckles having a twist-type locking mechanism, and other types of side-release buckles than those described herein. For instance, center-release buckles do not require two independent spring-fit arms to be pressed by the user to disengage the buckle members, but comprise a single mechanism for the user to press to disengage the buckle members. This increases the risk of center-release buckles inadvertently unlocking and generally renders these buckles less secure than side-release buckles which becomes a security issue when mounted to high value objects. The features and resulting advantages of the instant improved quick-release buckles, regardless of the type of quick-release buckle, are not possible with typical quick-release buckles.

It will be appreciated that in utilizing the instant fasteners, including in the above examples, the female end and the male end of the improved take-apart fastener or the male end and female end of the improved quick-release buckle may be mounted in either direction, including the opposite direction of the foregoing descriptions. For example, in a modified embodiment of FIGS. 2A and 2B, the male end 17 of the improved take-apart fastener may be mounted to the bottom portion of the neckband module 15 (knuckle facing downward) and the female end 18 of the improved take-apart fastener is then mounted to the top portion of torso segment one (key pointing upward) et cetera. Likewise, in a modified embodiment of FIGS. 3A and 3B, the female end 23 of the improved quick-release buckle may be mounted to the bottom portion of the neckband module 15 (opening of receiving chamber facing downward) and the male end 22 of the improved quick-release buckle is then mounted to the top portion of torso segment one (lead of center guide facing upward) et cetera.

The composition of the instant improved take-apart fasteners, instant improved quick-release buckles, hinge platforms, mounting shafts, mounting housings, pin receptacles and pins may each be made from a variety of suitable materials. For example, and in no way limiting, the instant fasteners, including any hinge platform, mounting shaft, mounting housing, pin receptacle or pin, may incorporate any of metals, metal alloys, fiber reinforced polymers and synthetic polymers including plastics. The composition of said instant fasteners, in addition to the composition of the neckband module, torso segments, or other articles as the case may be, play a role in determining the method of mounting the instant fasteners to the neckband module, torso segments or other articles. For example, if a hinge platform is a carbon-fiber reinforced polymer, brazing or welding is not an option to mount the fasteners to the neckband module or torso segments. The mounting methods utilized have insignificant effect on the functionality of a neckwear or other article including the intra-changeability and inter-changeability features. In some embodiments of an improved quick-release buckle, the hinge platform, mounting shaft, pin receptacle or mounting housing may include holes for mounting an article, and in other embodiments may not include holes for mounting an article. For example, a mounting housing may not have mounting holes and may be brazed or welded to an object.

What is claimed is:

1. An article comprising:

a quick-release buckle, including
a first buckle member, and
a second buckle member;

a first rigid panel; and a second rigid panel;

wherein either of said first buckle member or said second buckle member engages the other of said first buckle member or said second buckle member;

wherein the first buckle member comprises a center guide, a spring, two spring-fit arms; and the second buckle member comprises a receiving chamber with two release openings;

wherein the first buckle member is mounted to the first rigid panel via a first hinge, and the first buckle member rotates about the first hinge; and wherein the second buckle member is mounted to the second rigid panel via a second hinge, and the second buckle member rotates about the second hinge;

a first hinge tower is provided on the first rigid panel, and the first hinge is disposed above the first rigid panel by the first hinge tower;

a second hinge tower is provided on the second rigid panel, and the second hinge is disposed above the second rigid panel by the second hinge tower.

2. The article of claim 1, wherein said article is a neckwear.

3. The article according to claim 1, wherein the first hinge tower extends in a direction substantially perpendicular to a front plane of the first rigid panel, and the second hinge tower extends in a direction substantially perpendicular to a front plane of the second rigid panel.

4. The article according to claim 1, wherein the first rigid panel comprises a neckband module or a torso segment of a neckwear.

5. The article according to claim 1, wherein and the first rigid panel is a neckband module and the second rigid panel is a torso segment.

6. A neckwear, comprising:

a neckband configured to be positioned around the neck of a wearer;

a rigid neckband module connected to the neckband, the rigid neckband module comprising a first rigid panel;

a rigid torso segment connected to the rigid neckband module, the rigid torso segment comprising a second rigid panel;

a first buckle member mounted to the first rigid panel; and a second buckle member mounted to the second rigid panel, wherein either of said first buckle member or said second buckle member engages the other of said first buckle member or said second buckle member;

wherein the first buckle member comprises a center guide, a spring, two spring-fit arms; and the second buckle member comprises a receiving chamber with two release openings;

wherein the first buckle member is mounted to the first rigid panel via a first hinge and rotates about the first hinge;

the second buckle member is mounted to the second rigid panel via a second hinge and rotates about the second hinge;

a first hinge tower is provided on the first rigid panel, and the first hinge is disposed above the first rigid panel by the first hinge tower; and a second hinge tower is provided on the second rigid panel, and the second hinge is disposed above the second rigid panel by the second hinge tower.

7. A neckwear, comprising:

a neckband configured to be positioned around the neck of a wearer;

a neckband module connected to the neckband, a first rigid torso segment connected to the neckband module, the first rigid torso segment comprising a first rigid panel;

a second rigid torso segment connected to the first rigid torso segment, the second rigid torso segment comprising a second rigid panel;

a first buckle member mounted to the first rigid panel; and a second buckle member mounted to the second rigid panel, wherein either of said first buckle member or said second buckle member engages the other of said first buckle member or said second buckle member;

wherein the first buckle member comprises a center guide, a spring, two spring-fit arms; and the second buckle member comprises a receiving chamber with two release openings;

wherein the first buckle member is mounted to the first rigid panel via a first hinge and rotates about the first hinge;

the second buckle member is mounted to the second rigid panel via a second hinge and rotates about the second hinge;

a first hinge tower is provided on the first rigid panel, and the first hinge is disposed above the first rigid panel by the first hinge tower; and a second hinge tower is provided on the second rigid panel, and the second hinge is disposed above the second rigid panel by the second hinge tower.

* * * * *